US009157649B2

(12) United States Patent
Yamashita

(10) Patent No.: US 9,157,649 B2
(45) Date of Patent: Oct. 13, 2015

(54) AIR-CONDITIONING APPARATUS

(75) Inventor: Koji Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 348 days.

(21) Appl. No.: 13/884,366

(22) PCT Filed: Jan. 27, 2011

(86) PCT No.: PCT/JP2011/000442

§ 371 (c)(1),
(2), (4) Date: May 9, 2013

(87) PCT Pub. No.: WO2012/101676

PCT Pub. Date: Aug. 2, 2012

(65) Prior Publication Data

US 2013/0227976 A1 Sep. 5, 2013

(51) Int. Cl.
*F24F 11/00* (2006.01)
*F24F 3/06* (2006.01)
(Continued)

(52) U.S. Cl.
CPC ..... *F24F 11/001* (2013.01); *F24F 3/06* (2013.01); *F24F 3/065* (2013.01); *F25B 7/00* (2013.01); *F25B 9/006* (2013.01); *F25B 13/00* (2013.01);
(Continued)

(58) Field of Classification Search
CPC ..... F24F 11/001; F24F 3/06; F24F 3/065; F24F 2011/0043; F24F 2011/0045; F25B 7/00; F25B 49/02; F25B 13/00; F25B 9/006; F25B 25/005; F25B 2313/023; F25B 2313/0272; F25B 2313/02732; F25B 2313/02741; F25B 2400/08; F25B 2700/21
USPC ..... 62/114, 126, 185, 201
See application file for complete search history.

(56) References Cited

U.S. PATENT DOCUMENTS

2006/0254294 A1* 11/2006 Shimamoto et al. ..... 62/238.7
2013/0219940 A1* 8/2013 Yamashita ..... 62/160
2014/0090409 A1* 4/2014 Yamashita et al. ..... 62/196.1

FOREIGN PATENT DOCUMENTS

JP 2002-048359 A 2/2002
JP 2002-364936 A 12/2002
(Continued)

OTHER PUBLICATIONS

International Search Report of the International Searching Authority mailed Mar. 15, 2011 for the corresponding international application No. PCT/JP2011/000442 (with English translation).

*Primary Examiner* — Marc Norman
(74) *Attorney, Agent, or Firm* — Posz Law Group, PLC

(57) ABSTRACT

An air-conditioning apparatus includes a heat medium flow control device that adjusts the flow rate of a heat medium circulating in a use side heat exchanger, temperature sensors that are disposed in an inlet-side passage and an outlet-side passage of the use side heat exchanger and that detect temperatures of the heat medium, and a controller that controls the heat medium flow control device so that a temperature difference between a detection value of the temperature sensors is equal to a first target value. A refrigerant flowing through a refrigerant flow passage of the heat exchanger related to heat medium and a heat medium flowing through a heat medium flow passage of the heat exchanger related to heat medium are in counter flow relative to one another, and the controller changes the first target value in accordance with an operation state of a refrigerant circuit.

22 Claims, 12 Drawing Sheets

(51) Int. Cl.

| | |
|---|---|
| ***F25B 9/00*** | (2006.01) |
| ***F25B 13/00*** | (2006.01) |
| ***F25B 25/00*** | (2006.01) |
| ***F25B 7/00*** | (2006.01) |
| ***F25B 49/02*** | (2006.01) |

(52) U.S. Cl.

CPC ..... *F25B 25/005* (2013.01); *F25B 49/02* (2013.01); *F24F 2011/0043* (2013.01); *F24F 2011/0045* (2013.01); *F25B 2313/023* (2013.01); *F25B 2313/0272* (2013.01); *F25B 2313/02732* (2013.01); *F25B 2313/02741* (2013.01); *F25B 2400/08* (2013.01); *F25B 2700/21* (2013.01)

(56) References Cited

FOREIGN PATENT DOCUMENTS

| | | | |
|---|---|---|---|
| JP | 2003-343936 | A | 12/2003 |
| JP | 2004-286407 | A | 10/2004 |
| WO | 2010/049998 | A1 | 5/2010 |
| WO | 2010/050003 | A1 | 5/2010 |
| WO | 2010/131335 | A1 | 11/2010 |
| WO | 2010/131378 | A1 | 11/2010 |
| WO | WO 2014030236 | A1 * | 2/2014 |

* cited by examiner

AIR-CONDITIONING APPARATUS

CROSS REFRENCE TO RELATED APPLICATION

This application is a U.S. national stage application of International Application No. PCT/JP2011/000442 filed on Jan. 27,2011.

TECHNICAL FIELD

The present invention relates to an air-conditioning apparatus applicable to, for example, a multi-air-conditioning apparatus for a building or the like.

BACKGROUND ART

As a conventional air-conditioning apparatus in, such as, a multi-air-conditioning apparatus for buildings, there is an air-conditioning apparatus that causes a refrigerant to circulate from an outdoor unit to a heat medium relay unit (relay unit) and that causes a heat medium such as water to circulate from the heat medium relay unit to indoor units, so as to reduce the power used to convey the heat medium while causing the heat medium to circulate to the indoor units (for example, Patent Literature 1).

Further, as a conventional air-conditioning apparatus that uses a non-azeotropic refrigerant mixture, there is a chiller-type air-conditioning apparatus that causes a non-azeotropic refrigerant mixture and a heat medium to flow through a heat exchanger related to heat medium (refrigerant/heat medium heat exchanger) in opposite directions (that is, the flows are in counter flow relative to one another) to improve heat exchange efficiency (for example, Patent Literature 2).

Further, as a conventional air-conditioning apparatus that uses a non-azeotropic refrigerant mixture, there is a chiller-type air-conditioning apparatus that causes a non-azeotropic refrigerant mixture and a heat medium to flow through a heat exchanger related to heat medium serving as an evaporator of a refrigerant circuit in parallel in the same direction (that is, the flows are parallel flows) to prevent freezing of the heat medium while keeping the temperature of the heat medium at the inlet of the heat exchanger related to heat medium constant (for example, Patent Literature 3).

CITATION LIST

Patent Literature

Patent Literature 1: WO10/049,998 pamphlet (paragraphs [0007] and [0008], FIG. 1)

Patent Literature 2: Japanese Unexamined Patent Application Publication No. 2002-364936 (abstract, FIGS. 1 to 3)

Patent Literature 3: Japanese Unexamined Patent Application Publication No. 2004-286407 (abstract, FIG. 1)

SUMMARY OF INVENTION

Technical Problem

The conventional air-conditioning apparatus as described in Patent Literature 1 is configured to cause a refrigerant to circulate between an outdoor unit and a heat medium relay unit and to cause a heat medium such as water to circulate between the heat medium relay unit and indoor units, such that the heat medium relay unit exchanges heat between the refrigerant and the heat medium such as water. This reduces the power used to convey the heat medium and therefore improves the operation efficiency of the air-conditioning apparatus. However, since the conventional air-conditioning apparatus described in Patent Literature 1 is not designed to possibly use a non-azeotropic refrigerant mixture having a temperature glide between the saturated liquid temperature and the saturated gas temperature at the same pressure, the use of a non-azeotropic refrigerant mixture causes a disadvantage of not necessarily being possible to provide efficient operation.

The conventional air-conditioning apparatus described in Patent Literature 2 uses a non-azeotropic refrigerant mixture having a temperature glide in the heat exchange process, such that a refrigerant and a heat medium such as water, which flow through a heat exchanger related to heat medium, are in counter flow relative to one another. This allows the temperature glide of the refrigerant and the temperature glide of the heat medium to be in the same direction to improve the heat exchange efficiency of the heat exchanger related to heat medium. However, due to the presence of excess refrigerant or the like, a non-azeotropic refrigerant mixture undergoes a change in circulation compositions (a ratio of components in a refrigerant circulating in the refrigerant circuit) and a change in the temperature glide of the refrigerant. For this reason, a chiller-type air-conditioning apparatus such as the conventional air-conditioning apparatus described in Patent Literature 2 performs control to make the water supply temperature constant. Thus, once the temperature glide of the refrigerant changes, the temperature glides of the refrigerant and water may not necessarily match. Therefore, the conventional air-conditioning apparatus described in Patent Literature 2 does not allow the heat exchange efficiency of a refrigerant-heat medium heat exchanger to be controlled to be optimum, and energy savings are not achieved, disadvantageously.

The conventional air-conditioning apparatus described in Patent Literature 3 uses a non-azeotropic refrigerant mixture having a temperature glide in the heat exchange process, and a refrigerant and a heat medium such as water, which flow through a heat exchanger related to heat medium, are in parallel flow. For this reason, the conventional air-conditioning apparatus described in Patent Literature 3 can prevent freezing of the heat medium but has a disadvantage in that the heat exchange efficiency of the heat exchanger related to heat medium is not so good.

The present invention has been made in order to overcome the foregoing problems, and an object thereof is to provide an air-conditioning apparatus with good energy efficiency and capable of achieving energy savings even in the case of using a non-azeotropic refrigerant mixture having a temperature glide between the saturated liquid temperature and the saturated gas temperature at the same pressure.

Solution to Problem

An air-conditioning apparatus according to the present invention includes a refrigerant circuit in which a compressor, a refrigerant passage switching device that switches a passage of a refrigerant discharged from the compressor, a heat source side heat exchanger, a first expansion device, and a refrigerant flow passage of a heat exchanger related to heat medium are connected via a refrigerant pipe through which the refrigerant is distributed; a heat medium circuit in which a heat medium flow passage of the heat exchanger related to heat medium, a heat medium sending device, a use side heat exchanger, and a heat medium flow control device, the heat medium flow control device being disposed in an inlet-side passage or outlet-side passage of the use side heat exchanger and controlling a flow rate of the heat medium circulating in the use side heat exchanger, are connected via a heat medium pipe through which a heat medium is distributed; a first heat medium temperature detection device that is disposed in the inlet-side passage of the use side heat exchanger and that detects a temperature of the heat medium; a second heat medium temperature detection device that is disposed in the outlet-side passage of the use side heat exchanger and that detects a temperature of the heat medium; and a controller that controls the heat medium flow control device so that a temperature difference between a detection value of the first heat medium temperature detection device and a detection value of the second heat medium temperature detection device is equal to a first target value. The refrigerant flowing through the refrigerant flow passage of the heat exchanger related to heat medium and the heat medium flowing through the heat medium flow passage of the heat exchanger related to heat medium are in counter flow relative to one another. The controller changes the first target value, which is a target value in control of the temperature difference between the detection value of the first heat medium temperature detection device and the detection value of the second heat medium temperature detection device, in accordance with an operation state of the refrigerant circuit.

Advantageous Effects of Invention

In an air-conditioning apparatus according to the present invention, a refrigerant flowing through a refrigerant flow passage of a second heat exchanger and a heat medium flowing through a heat medium flow passage of the second heat exchanger are in counter flow relative to one another. Further, a target value in control of a temperature difference between a detection value of a first heat medium temperature detection device and a detection value of a second heat medium temperature detection device is changed in accordance with the operation state of a refrigerant circuit. Therefore, the air-conditioning apparatus according to the present invention can improve energy efficiency and achieve energy savings. In addition, if the temperature of the refrigerant decreases, the temperature of the heat medium can be controlled to prevent freezing.

Additionally, the air-conditioning apparatus according to the present invention is also capable of operating with a refrigerant other than a non-azeotropic refrigerant.

DESCRIPTION OF EMBODIMENTS

Embodiment

Figure 1:
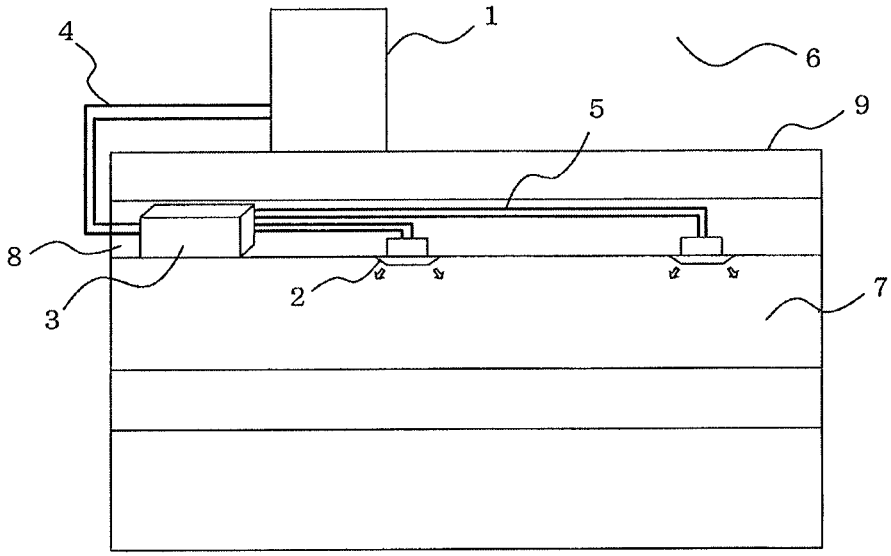
FIG. 1 is a schematic diagram illustrating an exemplary installation of an air-conditioning apparatus according to Embodiment of the present invention.

Embodiment of the present invention will be described with reference to the drawings. FIG. 1 is a schematic diagram illustrating an exemplary installation of an air-conditioning apparatus according to Embodiment of the present invention. An exemplary installation of the air-conditioning apparatus will be described with reference to FIG. 1. The illustrated air-conditioning apparatus uses a refrigerant circuit A that causes a refrigerant (heat source side refrigerant) to circulate and a heat medium circuit B that causes a heat medium to circulate, thereby being capable of freely selecting a cooling mode or a heating mode for each indoor unit as its operation mode. In the following drawings, including FIG. 1, the dimensional relationships between constituent members may be different from the actual ones.

In FIG. 1, the air-conditioning apparatus according to Embodiment includes a single outdoor unit 1, which is a heat source unit, a plurality of indoor units 2, and a heat medium relay unit 3 interposed between the outdoor unit 1 and the indoor units 2. The heat medium relay unit 3 is designed to exchange heat between a refrigerant and a heat medium. The outdoor unit 1 and the heat medium relay unit 3 are connected via refrigerant pipes 4 through which the refrigerant passes. The heat medium relay unit 3 and the indoor units 2 are connected via pipes (heat medium pipes) 5 through which the heat medium passes. Cooling energy or heating energy generated in the outdoor unit 1 is delivered to the indoor units 2 through the heat medium relay unit 3.

The outdoor unit 1 is generally installed in an outdoor space 6, which is an outside space (for example, a roof) of a structure 9 such as a building, and is designed to supply cooling energy or heating energy to the indoor units 2 through the heat medium relay unit 3. The indoor units 2 are installed at positions so as to be able to supply cooling air or heating air to an indoor space 7, which is an inside space (for example, a living room) of the structure 9, and are designed to supply the cooling air or heating air to the indoor space 7, which is an air-conditioned space. The heat medium relay unit 3 is configured as a housing separate from the outdoor unit 1 and the indoor units 2 such that the heat medium relay unit 3 can be installed at a position different from the outdoor space 6 and the indoor space 7. The heat medium relay unit 3 is connected to the outdoor unit 1 and the indoor units 2 via the refrigerant pipes 4 and the pipes 5, respectively, to transfer the cooling energy or heating energy supplied from the outdoor unit 1 to the indoor units 2.

As illustrated in FIG. 1, in the air-conditioning apparatus according to Embodiment, the outdoor unit 1 and the heat medium relay unit 3 are connected using two refrigerant pipes 4, and the heat medium relay unit 3 and each of the indoor units 2 are connected using two pipes 5. In this manner, the connection of each of the units (the outdoor unit 1, the indoor units 2, and the heat medium relay unit 3) using two pipes (the refrigerant pipes 4, the pipes 5) facilitates construction of the air-conditioning apparatus according to Embodiment.

In FIG. 1, by way of example, the heat medium relay unit 3 is located in a space which is inside the structure 9 but is a space different from the indoor space 7, such as a space above a ceiling (hereinafter referred to simply as the space 8). The heat medium relay unit 3 may also be located in any other place such as a common space where an elevator and the like are installed. In FIG. 1, furthermore, the indoor units 2 are of a ceiling cassette type, by way of example, but are not limited thereto, and may be of any type capable of blowing out heating air or cooling air to the indoor space 7 directly or through ducts or the like, such as a ceiling-concealed type or a ceiling-suspended type.

In FIG. 1, by way of example, the outdoor unit 1 is located in the outdoor space 6, but is not limited thereto. For example, the outdoor unit 1 may be located in an enclosed space such as a machine room with a ventilation opening, may be located inside the structure 9 so long as waste heat can be exhausted to the outside of the structure 9 through exhaust ducts, or may also be located inside the structure 9 when the used outdoor unit 1 is of a water-cooled type. Even if the outdoor unit 1 is installed in such a place, no particular problem will occur.

Further, the heat medium relay unit 3 can also be installed in the vicinity of the outdoor unit 1. It should be noted that if the distance from the heat medium relay unit 3 to the indoor units 2 is excessively long, a considerably high power is required to convey the heat medium, resulting in the effect of energy saving being impaired. Furthermore, the numbers of connected outdoor units 1, indoor units 2, and heat medium relay units 3 are not limited to those illustrated in FIG. 1, and may be determined in accordance with the structure 9 where the air-conditioning apparatus according to Embodiment is installed.

Figure 2:
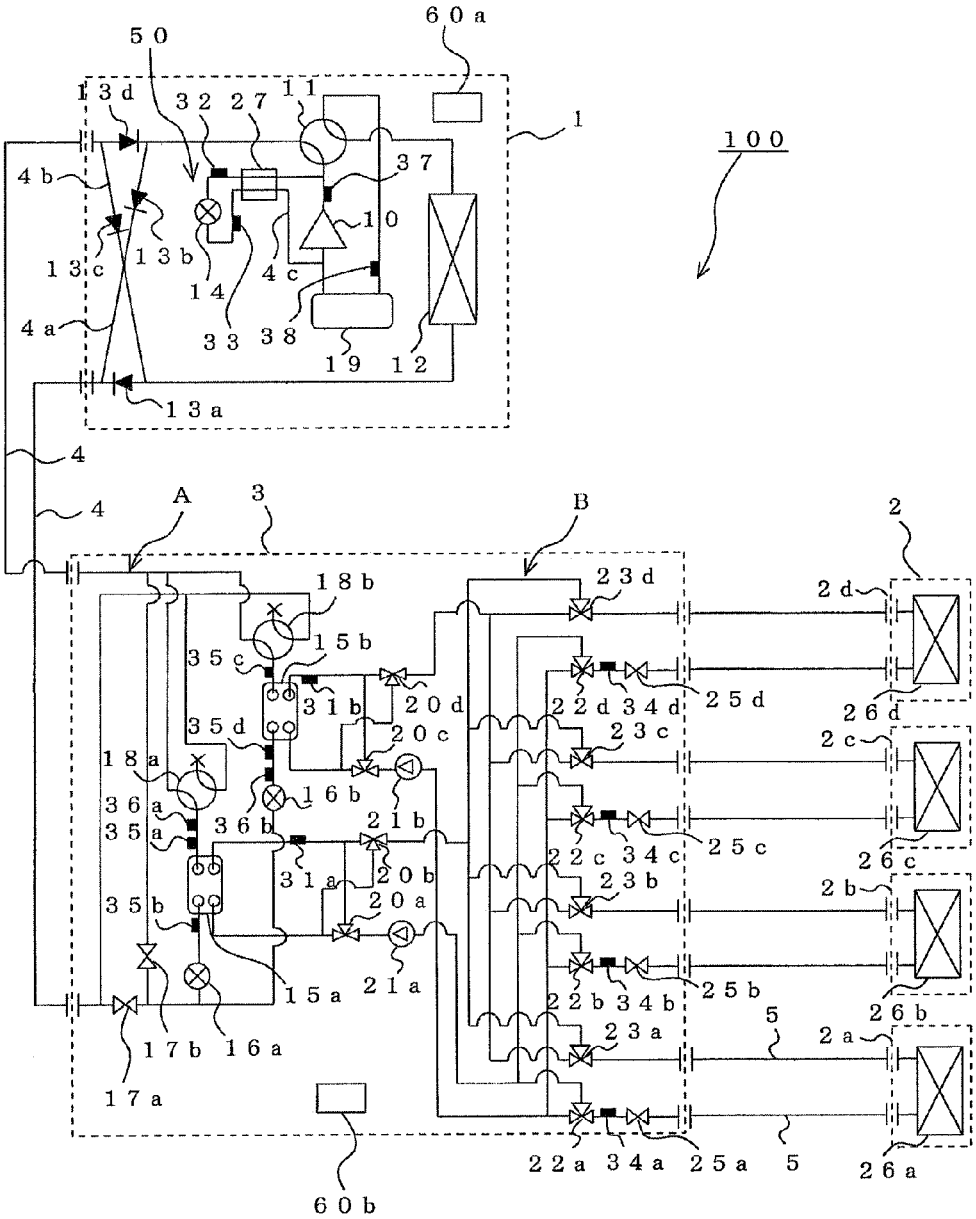
FIG. 2 is a schematic circuit configuration diagram illustrating an example circuit configuration of the air-conditioning apparatus according to Embodiment of the present invention.

FIG. 2 is a schematic circuit configuration diagram illustrating an example circuit configuration of the air-conditioning apparatus (hereinafter referred to as the air-conditioning apparatus 100) according to Embodiment of the present invention. The detailed configuration of the air-conditioning apparatus 100 will be described with reference to FIG. 2. As illustrated in FIG. 2, the outdoor unit 1 and the heat medium relay unit 3 are connected via the refrigerant pipes 4 through heat exchangers related to heat medium 15*a* and 15*b* included in the heat medium relay unit 3. The heat medium relay unit 3 and the indoor units 2 are also connected via the pipes 5 through the heat exchangers related to heat medium 15*a* and 15*b*.

[Outdoor Unit 1]

The outdoor unit 1 has a compressor 10, a first refrigerant passage switching device 11, such as a four-way valve, a heat source side heat exchanger 12, and an accumulator 19, which are connected in series via the refrigerant pipes 4. The outdoor unit 1 further includes a first connecting pipe 4*a*, a second connecting pipe 4*b*, a check valve 13*a*, a check valve 13*b*, a check valve 13*c*, and a check valve 13*d*. The provision of the first connecting pipe 4*a*, the second connecting pipe 4*b*, the check valve 13*a*, the check valve 13*b*, the check valve 13*c*, and the check valve 13*d* allows the refrigerant to flow into the heat medium relay unit 3 in a constant direction regardless of the operation requested by the indoor units 2.

The outdoor unit 1 further includes a high-low pressure bypass pipe 4*c* that connects a discharge-side passage and suction-side passage of the compressor 10, an expansion device 14 disposed in the high-low pressure bypass pipe 4*c*, a refrigerant-refrigerant heat exchanger 27 that exchanges heat between pipes located before and after the expansion device 14 (in other words, exchanges heat between the refrigerant flowing through the high-low pressure bypass pipe 4*c* on the inlet side of the expansion device 14 and the refrigerant flowing through the high-low pressure bypass pipe 4*c* on the outlet side of the expansion device 14), a high-pressure side refrigerant temperature detection device 32 and a low-pressure side refrigerant temperature detection device 33 disposed on the inlet side and outlet side of the expansion device 14, respectively, a high-pressure side pressure detection device 37 capable of detecting the high-pressure side pressure of the compressor 10 (that is, the pressure of the refrigerant discharged by the compressor 10), and a low-pressure side pressure detection device 38 capable of detecting the low-pressure side pressure of the compressor 10 (that is, the pressure on the low-pressure side of the compressor 10). The high-pressure side pressure detection device 37 and the low-pressure side pressure detection device 38, which are of a type such as a strain gauge type or a semiconductor type, are used, and the high-pressure side refrigerant temperature detection device 32 and the low-pressure side refrigerant temperature detection device 33, which are of a type such as a thermistor type, are used. Here, the expansion device 14 corresponds to a second expansion device in the present invention.

The compressor 10 is designed to suck the refrigerant and compress the refrigerant into a high-temperature and high-pressure state, and may be configured as, for example, a capacity-controllable inverter compressor or the like. The first refrigerant passage switching device 11 is designed to switch between the flow of the refrigerant in a heating operation (a heating only operation mode and a heating main operation mode) and the flow of the refrigerant in a cooling operation (a cooling only operation mode and a cooling main operation mode). The heat source side heat exchanger 12 serves as an evaporator in the heating operation, and serves as a condenser (or radiator) in the cooling operation. The heat source side heat exchanger 12 is designed to exchange heat between the air supplied from an air-sending device (not illustrated) such as a fan and the refrigerant, and to evaporate and gasify or condense and liquefy the refrigerant. The accumulator 19 is disposed on the suction side of the compressor 10, and is designed to store excess refrigerant.

The check valve 13*d* is disposed in the refrigerant pipe 4 between the heat medium relay unit 3 and the first refrigerant passage switching device 11, and is designed to permit the flow of the refrigerant only in a certain direction (the direction from the heat medium relay unit 3 to the outdoor unit 1). The check valve 13*a* is disposed in the refrigerant pipe 4 between the heat source side heat exchanger 12 and the heat medium relay unit 3, and is designed to permit the flow of the refrigerant only in a certain direction (the direction from the outdoor unit 1 to the heat medium relay unit 3). The check valve 13*b* is disposed in the first connecting pipe 4*a*, and is designed to distribute the refrigerant discharged from the compressor 10 to the heat medium relay unit 3 in the heating operation. The check valve 13*c* is disposed in the second connecting pipe 4*b*, and is designed to distribute the refrigerant returning from the heat medium relay unit 3 to the suction side of the compressor 10 in the heating operation.

The first connecting pipe 4*a* is designed, in the outdoor unit 1, to connect the refrigerant pipe 4 between the first refrigerant passage switching device 11 and the check valve 13*d* to the refrigerant pipe 4 between the check valve 13*a* and the heat medium relay unit 3. The second connecting pipe 4*b* is designed in the outdoor unit 1 to connect the refrigerant pipe 4 between the check valve 13*d* and the heat medium relay unit 3 to the refrigerant pipe 4 between the heat source side heat exchanger 12 and the check valve 13*a*. In FIG. 2, by way of example, the first connecting pipe 4*a*, the second connecting pipe 4*b*, the check valve 13*a*, the check valve 13*b*, the check valve 13*c*, and the check valve 13*d* are provided. However, Embodiment is not limited to this example. There components may not necessarily be provided.

In the refrigerant circuit A, a refrigerant mixture containing, for example, tetrafluoropropene, which is represented by chemical formula $C_3H_2F_4$ (HFO1234yf, which is represented by $CF_3CF{=}CH_2$, HFO1234ze, which is represented by $CF_3CH{=}CHF$, or the like) and difluoromethane (R32), which is represented by chemical formula $CH_2F_2$, circulates. Because the chemical formula has a double bond, tetrafluoropropene is easily decomposed in the atmosphere, and is an environment-friendly refrigerant with a low global warming potential (GWP) (for example, a GWP of 4). However, tetrafluoropropene has a lower density than conventional refrigerants such as R410A. For this reason, in a case where tetrafluoropropene is used alone as a refrigerant, a very large compressor may be required to exert high heating capacity or cooling capacity. In a case where tetrafluoropropene is used alone as a refrigerant, furthermore, thick refrigerant pipes may be required in order to prevent an increase in pressure loss at the pipes. Thus, if tetrafluoropropene is to be used alone as a refrigerant, a high-cost air-conditioning apparatus may be required. Meanwhile, R32 is a comparatively easy-to-use refrigerant because its characteristics are close to those of conventional ones. However, R32 has a GWP of, for example, 675, which is slightly high to use it alone as a refrigerant although the GWP of R32 is smaller than the GWP (for example, 2088) of R410A, which is a conventional refrigerant.

The air-conditioning apparatus 100 according to Embodiment uses a mixture of tetrafluoropropene and R32. Accordingly, the air-conditioning apparatus 100, which has improved characteristics of the refrigerant without greatly increasing GWP and therefore is earth-friendly and efficient, can be achieved. Tetrafluoropropene and R32 may be mixed at a mixture ratio of, for example, 70% to 30% in mass % for use. However, Embodiment is not limited to this mixture ratio.

A refrigerant mixture of, for example, HFO1234yf, which is a tetrafluoropropene, and R32 is a non-azeotropic refrigerant having different boiling points, where HFO1234yf has a boiling point of −29 degrees centigrade and R32 has a boiling point of −53.2 degrees centigrade. Due to the presence of a liquid receiver, such as the accumulator 19, or the like, the refrigerant circulating in the refrigerant circuit A has time-varying proportions of HFO1234yf and R32 (hereinafter referred to as circulation compositions).

Figure 3:
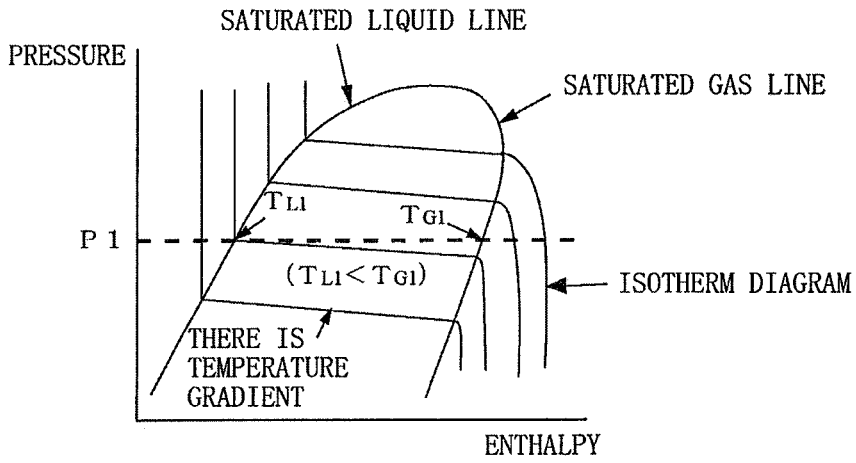
FIG. 3 is a P-h diagram (pressure-enthalpy diagram) of the air-conditioning apparatus according to Embodiment of the present invention.

Since a non-azeotropic refrigerant has mixture components (for example, HFO1234yf and R32) whose boiling points are different from one another, the saturated liquid temperature and the saturated gas temperature at the same pressure are different. Thus, a P-h diagram as in FIG. 3 is obtained. Specifically, as illustrated in FIG. 3, a saturated liquid temperature $T_{L1}$ and a saturated gas temperature $T_{G1}$ at a pressure P1 are not equal, where the temperature $T_{G1}$ is higher than the temperature $T_{L1}$. Thus, the isotherm lines in the two-phase region in the P-h diagram are inclined. Changing the ratio of the mixture components (mixed refrigerants) of the non-azeotropic refrigerant results in a different P-h diagram, yielding a change in temperature glide. For example, if the mixture ratio of HFO1234yf to R32 is 70 mass % to 30 mass %, the temperature glide is approximately 5.0 degrees centigrade on the high-pressure side and is approximately 6.6 degrees centigrade on the low-pressure side. Further, for example, if the mixture ratio of HFO1234yf to R32 is 50 mass % to 50 mass %, the temperature glide is approximately 2.2 degrees centigrade on the high-pressure side and is approximately 2.8 degrees centigrade on the low-pressure side. That is, a function of detecting the circulation compositions of the refrigerant is required to determine a saturated liquid temperature and a saturated gas temperature at the operating pressure in the refrigeration cycle.

In the air-conditioning apparatus 100 according to Embodiment, therefore, the outdoor unit 1 is provided with a refrigerant circulation composition detection device 50. The refrigerant circulation composition detection device 50, which includes the high-low pressure bypass pipe 4*c*, the expansion device 14, the refrigerant-refrigerant heat exchanger 27, the high-pressure side refrigerant temperature detection device 32, the low-pressure side refrigerant temperature detection device 33, the high-pressure side pressure detection device 37, and the low-pressure side pressure detection device 38, is used to measure the circulation compositions of the refrigerant circulating in the refrigerant circuit A.

A circulation composition measurement method according to Embodiment will be described hereinafter with FIGS. 4 to 6. A refrigerant mixture including two types of refrigerants is assumed here.

Figure 4:
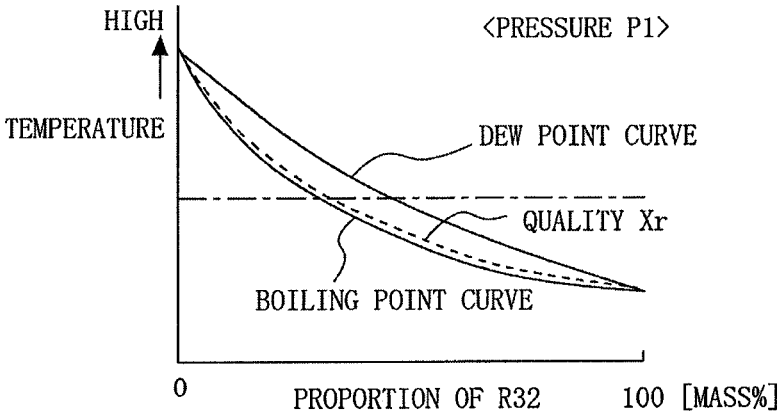
FIG. 4 is a vapor-liquid equilibrium diagram at a pressure P1 of a non-azeotropic refrigerant according to Embodiment of the present invention.

FIG. 4 is a vapor-liquid equilibrium diagram at the pressure P1 of the non-azeotropic refrigerant according to Embodiment of the present invention. FIG. 5 is a flowchart illustrating a circulation composition measurement method according to Embodiment of the present invention. FIG. 6 is a P-h diagram for the case where the non-azeotropic refrigerant according to Embodiment of the present invention is in the state of certain circulation compositions. Two solid lines illustrated in FIG. 4 indicate a dew point curve that is a saturated gas line when a gaseous refrigerant is condensed and liquefied, and a boiling point curve that is a saturated liquid line when a liquid refrigerant is evaporated and gasified. The procedure for circulation composition measurement illustrated in FIG. 5 is performed by a controller 60 included in the air-conditioning apparatus 100.

Figure 5:
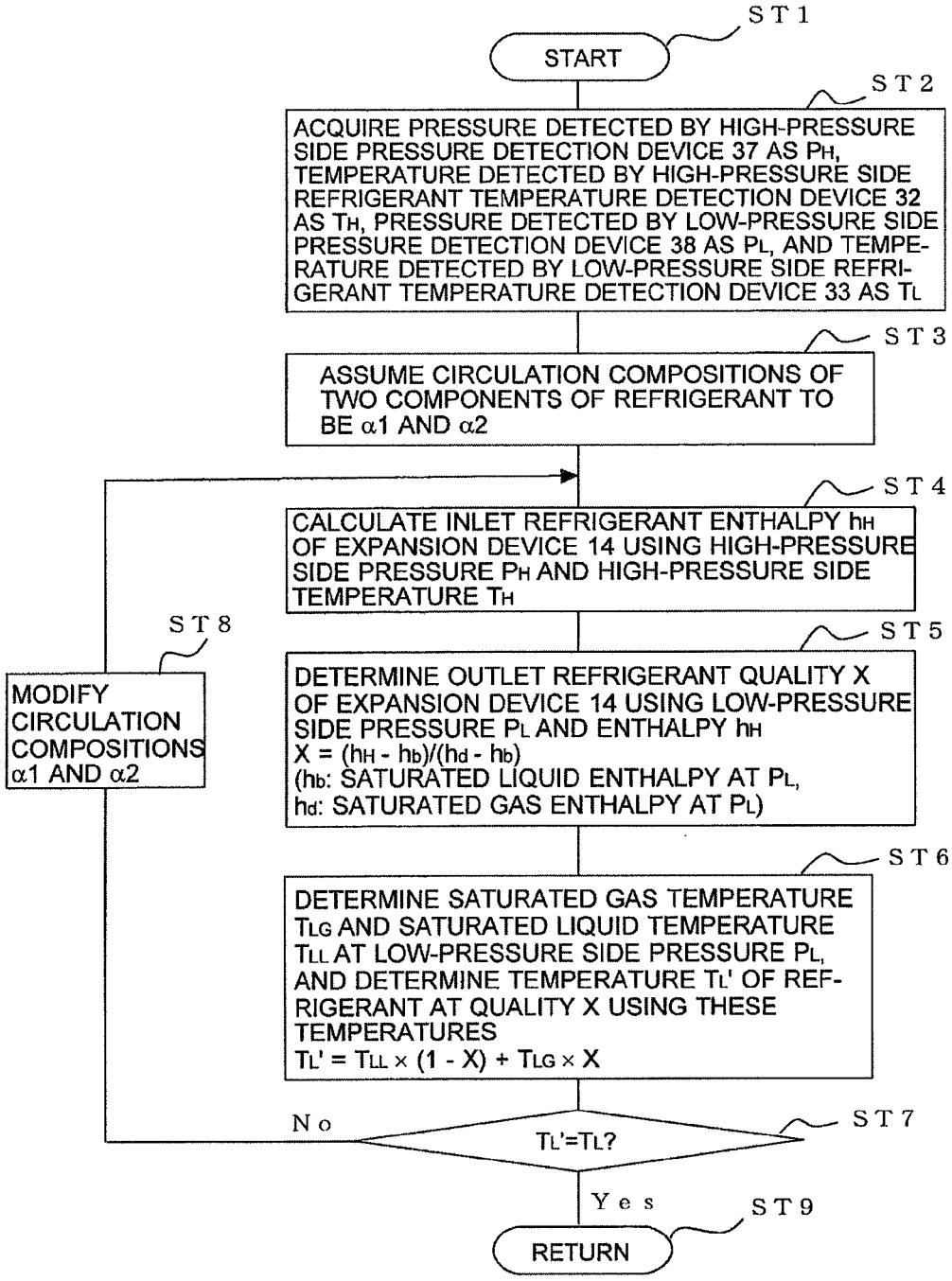
FIG. 5 is a flowchart illustrating a circulation composition measurement method according to Embodiment of the present invention.

As illustrated in FIG. 5, when the measurement of circulation compositions starts (ST1), the controller 60 acquires a pressure $P_H$ detected by the high-pressure side pressure detection device 37, a temperature $T_H$ detected by the high-pressure side refrigerant temperature detection device 32, a pressure $P_L$ detected by the low-pressure side pressure detection device 38, and a temperature $T_L$ detected by the low-pressure side refrigerant temperature detection device 33 (ST2). Then, the controller 60 assumes the circulation compositions of the two components of the refrigerant circulating in the refrigerant circuit A to be α1 and α2 (ST3).

Once the circulation compositions of the refrigerant are determined, the enthalpy of the refrigerant can be calculated from the P-h diagram (FIG. 6) of the circulation compositions, the pressure of the refrigerant, and the temperature of the refrigerant. Then, the controller 60 determines the enthalpy $h_H$ of the refrigerant on the inlet side of the expansion device 14 using the P-h diagram (or data (such as a table and a calculation formula) for determining the P-h diagram) when the circulation compositions of the refrigerant circulating in the refrigerant circuit A are α1 and α2, the pressure $P_H$ detected by the high-pressure side pressure detection device 37, and the temperature $T_H$ detected by the high-pressure side refrigerant temperature detection device 32 (ST4) (point C in FIG. 6). When the refrigerant is expanded by the expansion device 14, the enthalpy of the refrigerant does not change. This enables the controller 60 to determine a quality X of the two-phase refrigerant on the outlet side of the expansion device 14 using the pressure $P_L$ detected by the low-pressure side pressure detection device 38 and the calculated enthalpy $h_H$ (ST5) (point D in FIG. 6). Note that the controller 60 determines a quality X of the two-phase refrigerant on the outlet side of the expansion device 14 in accordance with Formula (1) given below.

$$X=(h_H-h_b)/(h_d-h_b) \quad (1)$$

Here, $h_b$ denotes the saturated liquid enthalpy at the pressure $P_L$ detected by the low-pressure side pressure detection device 38, and $h_d$ denotes the saturated gas enthalpy at the pressure $P_L$ detected by the low-pressure side pressure detection device 38.

In ST6, the controller 60 determines a saturated gas temperature $T_{LG}$ and a saturated liquid temperature $T_{LL}$ at the pressure $P_L$ detected by the low-pressure side pressure detection device 38. The saturated gas temperature $T_{LG}$ and the saturated liquid temperature $T_{LL}$ can be determined on the basis of, for example, the P-h diagram illustrated in FIG. 6 (or data (such as a table and a calculation formula) for determining the P-h diagram) obtained when the circulation compositions are α1 and α2 and the vapor-liquid equilibrium diagram illustrated in FIG. 4 (or data (such as a table and a calculation formula) for determining the vapor-liquid equilibrium diagram) obtained when the circulation compositions are α1 and α2. Further, the controller 60 determines the temperature $T_L'$ of the refrigerant at the quality X using the saturated gas temperature $T_{LG}$ and the saturated liquid temperature $T_{LL}$ at the pressure $P_L$ detected by the low-pressure side pressure detection device 38 in accordance with Formula (2) given below.

$$T_L'=T_{LL}\times(1-X)+T_{LG}\times X \quad (2)$$

In ST7, the controller 60 determines whether or not $T_L'$ is substantially equal to the temperature $T_L$ detected by the low-pressure side refrigerant temperature detection device 33 (that is, the controller 60 determines whether or not the difference between them is within a certain range). If the difference between $T_L'$ and $T_L$ is greater than the certain range, the controller 60 modifies the assumed circulation compositions α1 and α2 of the two components of the refrigerant (ST8), and repeats the process from ST4. If $T_L'$ and $T_L$ are substantially equal, the controller 60 regards circulation compositions as being successfully determined, and then the process ends (ST9).

Accordingly, the circulation compositions of a two-component non-azeotropic refrigerant mixture can be determined by the process described above.

In Embodiment, the enthalpy $h_H$ is calculated using the pressure $P_H$ detected by the high-pressure side pressure detection device 37. If the isotherm lines are substantially vertical in the subcooled-liquid region in FIG. 6 (P-h diagram), the enthalpy $h_H$ can be determined only using the temperature $T_H$ detected by the high-pressure side refrigerant temperature detection device 32 without installation of the high-pressure side pressure detection device 37. For example, for a refrigerant mixture of tetrafluoropropene (for example, HFO1234yf) and R32 and the like, the isotherm lines are substantially vertical in the subcooled-liquid region in the P-h diagram. Therefore, the high-pressure side pressure detection device 37 is not necessarily required when a refrigerant mixture of tetrafluoropropene (for example, HFO1234yf) and R32 or the like is used.

Even in a three-component non-azeotropic refrigerant mixture, a correlation is established between the proportions of two components among the three components. Thus, once the circulation compositions of two components are assumed, the circulation composition of the other component can be determined, and the circulation compositions can therefore be determined using a similar processing method. In Embodiment, the description has been given taking an example of a two-component refrigerant mixture containing tetrafluoropropene, which is represented by chemical formula $C_3H_2F_4$ (HFO1234yf, which is represented by $CF_3CF{=}CH_2$, HFO1234ze, which is represented by $CF_3CH{=}CHF$, or the like) and difluoromethane (R32), which is represented by chemical formula $CH_2F_2$, but Embodiment is not limited thereto. Any other two-component refrigerant mixture having different boiling points or a three-component refrigerant mixture including an additional component may be used, and the circulation compositions can be determined using a similar method.

Further, the expansion device 14 may be an electronic expansion valve whose opening degree is variable, or may be a device with a fixed aperture, such as a capillary tube. Further, the refrigerant-refrigerant heat exchanger 27 may be, but not limited to, a double-pipe heat exchanger. A plate-type heat exchanger, a micro-channel heat exchanger, or the like may be used, or any type that allows heat exchange between a high-pressure refrigerant and a low-pressure refrigerant may be used. In the illustration of FIG. 2, the low-pressure side pressure detection device 38 is located in the passage between the accumulator 19 and the refrigerant passage switching device 11. However, the position at which the low-pressure side pressure detection device 38 is disposed is not limited to the illustrated one. The low-pressure side pressure detection device 38 may be disposed at any position where the low-pressure side pressure of the compressor 10 can be measured, such as in the passage between the compressor 10 and the accumulator 19. Further, the position at which the high-pressure side pressure detection device 37 is disposed is not limited to the position illustrated in FIG. 2. The high-pressure side pressure detection device 37 may be disposed at any position where the high-pressure pressure side of the compressor 10 can be measured.

As described above, once the circulation compositions of the refrigerant circulating in the refrigerant circuit A can be measured, a saturated liquid temperature and a saturated gas temperature at a certain pressure can be calculated. For example, if the pressure of the refrigerant flowing into the heat exchanger is P1, the saturated liquid temperature and the saturated gas temperature at that pressure can be calculated using FIG. 4. Then, the saturated liquid temperature and the saturated gas temperature may be used, and, for example, an average temperature of them may be determined. The average temperature may be used as the saturated temperature at that pressure, and may be used to control the compressor and the expansion devices. Since the thermal conductivity of the refrigerant differs depending on quality, a weighted average temperature of a saturated liquid temperature and a saturated gas temperature which are weighted may be used as the saturated temperature.

On the low-pressure side (the evaporation side), it is possible to determine a saturated liquid temperature, a saturated gas temperature, and so forth without measuring a pressure. More specifically, the temperature of the two-phase refrigerant at the inlet of the evaporator is measured, and is assumed to be the saturated liquid temperature or the temperature of the two-phase refrigerant at a set quality. An inverse calculation of a relational expression (formula into which FIG. 4 is transformed) for determining a saturated liquid temperature and a saturated gas temperature using circulation compositions and a pressure can determine the pressure, the saturated gas temperature, and so forth. Accordingly, a pressure detection device is not necessarily required on the low-pressure side (evaporation side). Since this calculation method requires that a measured temperature be assumed to be a saturated liquid temperature or a quality be set from a measured temperature, a saturated liquid temperature and a saturated gas temperature can be determined with higher accuracy by using a pressure detection device.

[Indoor Unit 2]

Each of the indoor units 2 includes a use side heat exchanger 26. The use side heat exchangers 26 are designed to be connected to heat medium flow control devices 25 and first heat medium passage switching devices 23 of the heat medium relay unit 3 via the pipes 5. The use side heat exchangers 26 are designed to exchange heat between the air supplied from air-sending devices (not illustrated) such as fans and the heat medium to generate heating air or cooling air to be supplied to the indoor space 7.

In the illustration of FIG. 2, by way of example, four indoor units 2 are connected to the heat medium relay unit 3, and are illustrated as an indoor unit 2*a*, an indoor unit 2*b*, an indoor unit 2*c*, and an indoor unit 2*d* in this order from bottom to top of the drawing. In correspondence with the indoor units 2*a* to 2*d*, the use side heat exchangers 26 are also illustrated as a use side heat exchanger 26*a*, a use side heat exchanger 26*b*, a use side heat exchanger 26*c*, and a use side heat exchanger 26*d* in this order from bottom to top of the drawing. As in FIG. 1, the number of connected indoor units 2 is not limited to four, which is illustrated in FIG. 2.

[Heat Medium Relay Unit 3]

The heat medium relay unit 3 has the two heat exchangers related to heat medium 15, two expansion devices 16, two opening and closing devices 17, two second refrigerant passage switching devices 18, two pumps 21 (heat medium sending devices), four second heat medium passage switching devices 22, four heat medium passage reversing devices 20, the four first heat medium passage switching devices 23, and the four heat medium flow control devices 25. Here, the expansion devices 16 correspond to a first expansion device in the present invention, the first heat medium passage switching devices 23 correspond to a first heat medium passage switching device in the present invention, and the second heat medium passage switching devices 22 correspond to a second heat medium passage switching device in the present invention.

Each of the two heat exchangers related to heat medium 15 (the heat exchanger related to heat medium 15*a* and the heat exchanger related to heat medium 15*b*) serves as a condenser (radiator) or an evaporator, and is designed to exchange heat between the refrigerant and the heat medium to transfer the cooling energy or heating energy generated by the outdoor unit 1 and stored in the refrigerant to the heat medium. In other words, each of the two heat exchangers related to heat medium 15 (the heat exchanger related to heat medium 15*a* and the heat exchanger related to heat medium 15*b*) is designed to serve as a cooler for cooling the heat medium or a heater for heating the heat medium. The heat exchanger related to heat medium 15*a* is disposed between an expansion device 16*a* and a second refrigerant passage switching device 18*a* in the refrigerant circuit A, and is designed to cool the heat medium in the cooling and heating mixed operation mode. The heat exchanger related to heat medium 15*b* is disposed between an expansion device 16*b* and a second refrigerant passage switching device 18*b* in the refrigerant circuit A, and is designed to heat the heat medium in the cooling and heating mixed operation mode.

Each of the two expansion devices 16 (the expansion device 16*a* and the expansion device 16*b*) has functions of a pressure reducing valve and an expansion valve, and is designed to reduce the pressure of the refrigerant and expand the refrigerant. The expansion device 16*a* is disposed in the upstream of the heat exchanger related to heat medium 15*a* in the flow of the refrigerant in the cooling operation. The expansion device 16*b* is disposed in the upstream of the heat exchanger related to heat medium 15*b* in the flow of the refrigerant in the cooling operation. Each of the two expansion devices 16 may be configured as a device whose opening degree is variably controllable, such as an electronic expansion valve.

Each of the two opening and closing devices 17 (an opening and closing device 17*a* and an opening and closing device 17*b*) is configured as a two-way valve or the like, and is designed to open and close the refrigerant pipe 4. The opening and closing device 17*a* is disposed in the refrigerant pipe 4 on the refrigerant inlet side. The opening and closing device 17*b* is disposed in a pipe that connects the refrigerant pipes 4 on the refrigerant inlet and outlet sides. Each of the two second refrigerant passage switching devices 18 (a second refrigerant passage switching device 18*a* and a second refrigerant passage switching device 18*b*) includes a four-way valve or the like, and is designed to switch the flow of the refrigerant in accordance with the operation mode. The second refrigerant passage switching device 18*a* is disposed in the downstream of the heat exchanger related to heat medium 15*a* in the flow of the refrigerant in the cooling operation. The second refrigerant passage switching device 18*b* is disposed in the downstream of the heat exchanger related to heat medium 15*b* in the flow of the refrigerant in the cooling only operation.

Each of the two pumps 21 (a pump 21*a* and a pump 21*b*) is designed to circulate the heat medium passing through the pipe 5. The pump 21*a* is disposed in the pipe 5 between the heat exchanger related to heat medium 15*a* and the second heat medium passage switching devices 22. The pump 21*b* is disposed in the pipe 5 between the heat exchanger related to heat medium 15*b* and the second heat medium passage switching devices 22. Each of the two pumps 21 may be configured as, for example, a capacity-controllable pump or the like.

Each of the four heat medium passage reversing devices 20 (heat medium passage reversing devices 20*a* to 20*d*) is configured as a three-way valve or the like, and is designed to switch the flow direction of the heat medium in the heat exchangers related to heat medium 15*a* and 15*b*. Two of the heat medium passage reversing devices 20 are disposed for each of the heat exchangers related to heat medium 15. In the heat medium passage reversing device 20*a*, one of the three ways is connected to the pump 21*a* (heat medium sending device), another of the three ways is connected to one end of the heat exchanger related to heat medium 15*a*, and the other of the three ways is connected to a passage between the other end of the heat exchanger related to heat medium 15*a* and the heat medium passage reversing device 20*b*. In the heat medium passage reversing device 20*b*, one of the three ways is connected to the other end of the heat exchanger related to heat medium 15*a*, another of the three ways is connected to a passage between the one end of the heat exchanger related to heat medium 15*a* and the heat medium passage reversing device 20*a*, and the other of the three ways is connected to the first heat medium passage switching devices 23*a* to 23*d*. The direction of the heat medium to be distributed to the heat exchanger related to heat medium 15*a* is changed by switching the heat medium passage reversing device 20*a* and the heat medium passage reversing device 20*b*. Here, the heat medium passage reversing device 20*a* corresponds to a first heat medium passage reversing device in the present invention, and the heat medium passage reversing device 20*b* corresponds to a second heat medium passage reversing device in the present invention.

Further, in the heat medium passage reversing device 20*c*, one of the three ways is connected to the pump 21*b* (heat medium sending device), another of the three ways is connected to one end of the heat exchanger related to heat medium 15*b*, and the other of the three ways is connected to a passage between the other end of the heat exchanger related to heat medium 15*b* and the heat medium passage reversing device 20*d*. In the heat medium passage reversing device 20*d*, one of the three ways is connected to the other end of the heat exchanger related to heat medium 15*b*, another of the three ways is connected to a passage between the one end of the heat exchanger related to heat medium 15*b* and the heat medium passage reversing device 20*c*, and the other of the three ways is connected to the first heat medium passage switching devices 23*a* to 23*d*. The direction of the heat medium to be distributed to the heat exchanger related to heat medium 15*b* is changed by switching the heat medium passage reversing device 20*c* and the heat medium passage reversing device 20*d*. Here, the heat medium passage reversing device 20*c* corresponds to the first heat medium passage reversing device in the present invention, and the heat medium passage reversing device 20*d* corresponds to the second heat medium passage reversing device in the present invention.

Each of the four second heat medium passage switching devices 22 (second heat medium passage switching devices 22*a* to 22*d*) is configured as a three-way valve or the like, and is designed to switch the passage of the heat medium. The second heat medium passage switching devices 22, the number of which corresponds to the number of installed indoor units 2 (here, four), are arranged. In each of the second heat medium passage switching devices 22, one of the three ways is connected to the heat exchanger related to heat medium 15*a*, another of the three ways is connected to the heat exchanger related to heat medium 15*b*, and the other of the three ways is connected to the corresponding one of the heat medium flow control devices 25. The second heat medium passage switching devices 22 are disposed on the outlet side of the heat medium passages of the use side heat exchangers 26. The second heat medium passage switching device 22*a*, the second heat medium passage switching device 22*b*, the second heat medium passage switching device 22*c*, and the second heat medium passage switching device 22*d* are illustrated in this order from bottom to top of the drawing in correspondence with the indoor units 2.

Each of the four first heat medium passage switching devices 23 (first heat medium passage switching devices 23*a* to 23*d*) is configured as a three-way valve or the like, and is designed to switch the passage of the heat medium. The first heat medium passage switching devices 23, the number of which corresponds to the number of installed indoor units 2 (here, four), are arranged. In each of the first heat medium passage switching devices 23, one of the three ways is connected to the heat exchanger related to heat medium 15*a*, another of the three ways is connected to the heat exchanger related to heat medium 15*b*, and the other of the three ways is connected to the corresponding one of the use side heat exchangers 26. The first heat medium passage switching devices 23 are disposed on the inlet side of the heat medium passages of the use side heat exchangers 26. The first heat medium passage switching device 23*a*, the first heat medium passage switching device 23*b*, the first heat medium passage switching device 23*c*, and the first heat medium passage switching device 23*d* are illustrated in this order from bottom to top of the drawing in correspondence with the indoor units 2.

Each of the four heat medium flow control devices 25 (heat medium flow control devices 25*a* to 25*d*) is configured as a two-way valve or the like whose opening area is controllable, and is designed to control the flow rate of the flow in the pipe 5. The heat medium flow control devices 25, the number of which corresponds to the number of installed indoor units 2 (here, four), are arranged. In each of the heat medium flow control devices 25, one is connected to the corresponding one of the use side heat exchangers 26 and the other is connected to the corresponding one of the second heat medium passage switching devices 22. The heat medium flow control devices 25 are disposed on the outlet side of the heat medium passages of the use side heat exchangers 26. The heat medium flow control device 25*a*, the heat medium flow control device 25*b*, the heat medium flow control device 25*c*, and the heat medium flow control device 25*d* are illustrated in this order from bottom to top of the drawing in correspondence with the indoor units 2. The heat medium flow control devices 25 may be disposed on the inlet side of the heat medium passages of the use side heat exchangers 26.

The heat medium relay unit 3 is further provided with various detection devices (two temperature sensors 31, four temperature sensors 34, four temperature sensors 35, and two pressure sensors 36). Information (temperature information and pressure information) detected by these detection devices is sent to the controller 60, which controls the overall operation of the air-conditioning apparatus 100, to use the information for control such as the driving frequency of the compressor 10, the rotation speed of the air-sending devices (not illustrated), switching of the first refrigerant passage switching device 11, the driving frequency of the pumps 21, switching of the second refrigerant passage switching devices 18, and switching of the passage of the heat medium. Here, the temperature sensors 34 correspond to a first heat medium temperature detection device in the present invention, and the temperature sensors 31 correspond to a second heat medium temperature detection device in the present invention.

Each of the two temperature sensors 31 (a temperature sensor 31*a* and a temperature sensor 31*b*) is designed to detect the temperature of the heat medium flowing out of the corresponding one of the heat exchangers related to heat medium 15, that is, the temperature of the heat medium at the outlet of the corresponding one of the heat exchangers related to heat medium 15, and may be configured as, for example, a thermistor or the like. The temperature sensor 31*a* is disposed in the pipe 5 on the inlet side of the pump 21*a*. The temperature sensor 31*b* is disposed in the pipe 5 on the inlet side of the pump 21*b*.

Each of the four temperature sensors 34 (temperature sensors 34*a* to 34*d*) is disposed between the corresponding one of the second heat medium passage switching devices 22 and the corresponding one of the heat medium flow control devices 25. Each of the four temperature sensors 34 is designed to detect the temperature of the heat medium flowing out of the corresponding one of the use side heat exchangers 26, and may be configured as a thermistor or the like. The temperature sensors 34, the number of which corresponds to the number of installed indoor units 2 (here, four), are arranged. The temperature sensor 34*a*, the temperature sensor 34*b*, the temperature sensor 34*c*, and the temperature sensor 34*d* are illustrated in this order from bottom to top of the drawing in correspondence with the indoor units 2.

Each of the four temperature sensors 35 (temperature sensors 35*a* to 35*d*) is disposed on the refrigerant inlet or outlet side of the corresponding one of the heat exchangers related to heat medium 15. Each of the four temperature sensors 35 is designed to detect the temperature of the refrigerant flowing into the corresponding one of the heat exchangers related to heat medium 15 or the temperature of the refrigerant flowing out of the corresponding one of the heat exchangers related to heat medium 15, and may be configured as a thermistor or the like. The temperature sensor 35*a* is disposed between the heat exchanger related to heat medium 15*a* and the second refrigerant passage switching device 18*a*. The temperature sensor 35*b* is disposed between the heat exchanger related to heat medium 15*a* and the expansion device 16*a*. The temperature sensor 35*c* is disposed between the heat exchanger related to heat medium 15*b* and the second refrigerant passage switching device 18*b*. The temperature sensor 35*d* is disposed between the heat exchanger related to heat medium 15*b* and the expansion device 16*b*.

A pressure sensor 36*b* is disposed between, similarly to the installation position of the temperature sensor 35*d*, the heat exchanger related to heat medium 15*b* and the expansion device 16*b*, and is designed to detect the pressure of the refrigerant flowing between the heat exchanger related to heat medium 15*b* and the expansion device 16*b*. A pressure sensor 36*a* is disposed between, similarly to the installation position of the temperature sensor 35*a*, the heat exchanger related to heat medium 15*a* and the second refrigerant passage switching device 18*a*, and is designed to detect the pressure of the refrigerant flowing between the heat exchanger related to heat medium 15*a* and the second refrigerant passage switching device 18*a*.

Further, the controller 60 is configured as a microcomputer or the like, and is designed to control the driving frequency of the compressor 10, the rotation speed (including ON/OFF) of the air-sending devices, switching of the first refrigerant passage switching device 11, the driving of the pumps 21, the opening degree of the expansion devices 16, the opening and closing of the opening and closing devices 17, switching of the second refrigerant passage switching devices 18, switching of the heat medium passage reversing devices 20, switching of the second heat medium passage switching devices 22, switching of the first heat medium passage switching devices 23, the opening degree of the heat medium flow control devices 25, and so forth in accordance with the information detected by the various detection devices and instructions from various remote controls to execute operation modes described below. In Embodiment, the controller 60 is divided into a controller 60*a* and a controller 60*b*, such that the controller 60*a* is disposed in the outdoor unit 1 and the controller 60*b* is disposed in the heat medium relay unit 3. However, the method for installing the controller 60 is not limited to the method illustrated in Embodiment, and the controller 60 may be disposed in only the outdoor unit 1, the heat medium relay unit 3, or the indoor units 2. For example, furthermore, the controller 60*b* may be disposed individually in the heat medium relay unit 3 and the indoor units 2. That is, any installation method for the controller 60 may be used. Here, the controller 60*a* corresponds to a first controller in the present invention, and the controller 60*b* corresponds to a second controller in the present invention.

The pipes 5 through which the heat medium passes include pipes connected to the heat exchanger related to heat medium 15*a* and pipes connected to the heat exchanger related to heat medium 15*b*. The pipes 5 have branching pipes (here, four pipes), the number of which corresponds to the number of indoor units 2 connected to the heat medium relay unit 3. The pipes 5 are connected to the second heat medium passage switching devices 22 and the first heat medium passage switching devices 23. The second heat medium passage switching devices 22 and the first heat medium passage switching devices 23 are controlled to determine whether to cause the heat medium flowing from the heat exchanger related to heat medium 15*a* to flow into the use side heat exchangers 26 or to cause the heat medium flowing from the heat exchanger related to heat medium 15*b* to flow into the use side heat exchangers 26.

In the air-conditioning apparatus 100, the refrigerant circuit A is formed by connecting the compressor 10, the first refrigerant passage switching device 11, the heat source side heat exchanger 12, the opening and closing devices 17, the second refrigerant passage switching devices 18, the refrigerant passages of the heat exchangers related to heat medium 15, the expansion devices 16, and the accumulator 19 via the refrigerant pipes 4. Further, the heat medium circuit B is formed by connecting the heat medium passages of the heat exchangers related to heat medium 15, the pumps 21, the second heat medium passage switching devices 22, the heat medium flow control devices 25, the use side heat exchangers 26, and the first heat medium passage switching devices 23 via the pipes 5. That is, a plurality of use side heat exchangers 26 are connected in parallel to each of the heat exchangers related to heat medium 15, thereby making the heat medium circuit B have a plurality of systems.

Therefore, in the air-conditioning apparatus 100, the outdoor unit 1 and the heat medium relay unit 3 are connected through the heat exchangers related to heat medium 15*a* and 15*b* disposed in the heat medium relay unit 3, and the heat medium relay unit 3 and the indoor units 2 are also connected through the heat exchangers related to heat medium 15*a* and 15*b*. That is, the air-conditioning apparatus 100 allows heat exchange between the refrigerant circulating in the refrigerant circuit A and the heat medium circulating in the heat medium circuit B at the heat exchanger related to heat medium 15*a* and the heat exchanger related to heat medium 15*b*.

Subsequently, the operation modes of the air-conditioning apparatus 100 will be described. The air-conditioning apparatus 100 allows each of the indoor units 2 to perform a cooling operation or a heating operation in accordance with an instruction from the indoor unit 2. That is, the air-conditioning apparatus 100 is designed to allow all the indoor units 2 to perform the same operation and also allow each of the indoor units 2 to perform a different operation.

The operation modes of the air-conditioning apparatus 100 include a cooling only operation mode in which all the indoor units 2 in operation perform the cooling operation, a heating only operation mode in which all the indoor units 2 in operation perform the heating operation, a cooling main operation mode in which cooling load is the larger, and a heating main operation mode in which heating load is the larger. The individual operation modes will be described hereinafter along the flows of the refrigerant and the heat medium.

[Cooling Only Operation Mode]

Figure 7:
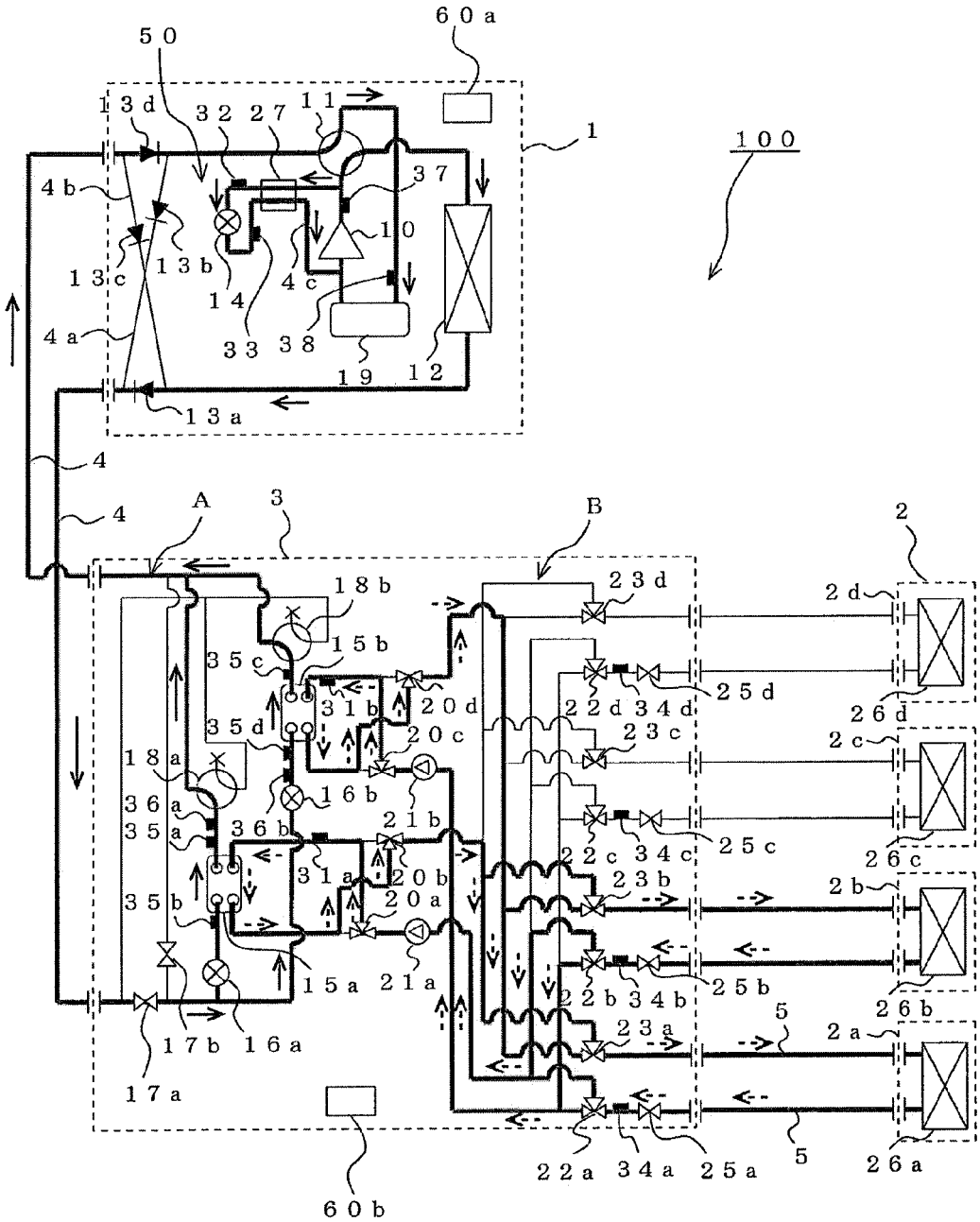
FIG. 7 is a system circuit diagram illustrating the flows of a refrigerant and a heat medium in a cooling only operation mode of the air-conditioning apparatus according to Embodiment of the present invention.

FIG. 7 is a system circuit diagram illustrating the flows of the refrigerant and the heat medium in the cooling only operation mode of the air-conditioning apparatus according to Embodiment of the present invention. Referring to FIG. 7, a description will be given of the cooling only operation mode, taking an example where cooling energy load is generated only in the use side heat exchanger 26*a* and the use side heat exchanger 26*b*. In FIG. 7, pipes indicated by thick lines represent pipes through which the refrigerant and the heat medium flow. In FIG. 7, furthermore, the direction of the flow of the refrigerant is indicated by solid line arrows, and the direction of the flow of the heat medium is indicated by broken line arrows.

In the cooling only operation mode illustrated in FIG. 7, in the outdoor unit 1, the first refrigerant passage switching device 11 is switched so as to cause the refrigerant discharged from the compressor 10 to flow into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed so that the heat medium circulates between each of the heat exchanger related to heat medium 15*a* and the heat exchanger related to heat medium 15*b* and the use side heat exchanger 26*a* and between each of the heat exchanger related to heat medium 15*a* and the heat exchanger related to heat medium 15*b* and the use side heat exchanger 26*b*. In the heat medium relay unit 3, furthermore, the opening and closing device 17*a* is opened and the opening and closing device 17*b* is closed.

First, the flow of the refrigerant in the refrigerant circuit A will be described.

A low-temperature and low-pressure refrigerant is compressed by the compressor 10 into a high-temperature and high-pressure gaseous refrigerant, which is then discharged. The high-temperature and high-pressure gaseous refrigerant discharged from the compressor 10 flows into the heat source side heat exchanger 12 through the first refrigerant passage switching device 11. Then, the gaseous refrigerant is condensed and liquefied by the heat source side heat exchanger 12, while transferring heat to the outdoor air, into a high-pressure liquid refrigerant. The high-pressure liquid refrigerant flowing out of the heat source side heat exchanger 12 flows out of the outdoor unit 1 through the check valve 13*a*, and flows into the heat medium relay unit 3 through the refrigerant pipe 4. The flow of the high-pressure liquid refrigerant flowing into the heat medium relay unit 3 is split after it flows through the opening and closing device 17*a* into a low-temperature and low-pressure two-phase refrigerant after being expanded by the expansion devices 16*a* and 16*b*.

The two-phase refrigerant flows individually into the heat exchangers related to heat medium 15*a* and 15*b* serving as evaporators (coolers) from the lower portion of the drawing, and absorbs heat from the heat medium circulating in the heat medium circuit B to cool the heat medium, so that the two-phase refrigerant is turned into a low-temperature and low-pressure gaseous refrigerant. The gaseous refrigerants flowing out of the heat exchangers related to heat medium 15*a* and 15*b* from the upper portion of the drawing flow out of the heat medium relay unit 3 through the second refrigerant passage switching devices 18*a* and 18*b*, respectively, and again flow into the outdoor unit 1 through the refrigerant pipe 4. The refrigerants flowing into the outdoor unit 1 flow through the check valve 13*d*, and are again sucked into the compressor 10 through the first refrigerant passage switching device 11 and the accumulator 19.

The circulation compositions of the refrigerant circulating in the refrigerant circuit A are measured by using the refrigerant circulation composition detection device 50 (the high-low pressure bypass pipe 4*c*, the expansion device 14, the refrigerant-refrigerant heat exchanger 27, the high-pressure side refrigerant temperature detection device 32, the low-pressure side refrigerant temperature detection device 33, the high-pressure side pressure detection device 37, and the low-pressure side pressure detection device 38). The controller 60*a* in the outdoor unit 1 and the controller 60*b* in the heat medium relay unit 3 are connected via wire or wirelessly so as to be capable of communicating with each other, and the circulation compositions calculated by the controller 60*a* in the outdoor unit 1 are transmitted via communication from the controller 60*a* in the outdoor unit 1 to the controller 60*b* in the heat medium relay unit 3.

The controller 60*b* in the heat medium relay unit 3 calculates a saturated liquid temperature and a saturated gas temperature on the basis of the circulation compositions transmitted from the controller 60*a* in the outdoor unit 1 and the pressure detected by the pressure sensor 36*a*. Further, the controller 60*b* in the heat medium relay unit 3 calculates an average temperature of the saturated liquid temperature and the saturated gas temperature to determine an evaporating temperature. Then, the controller 60*b* in the heat medium relay unit 3 controls the opening degree of the expansion device 16*a* so that superheat (the degree of superheating) obtained as a temperature difference between the temperature detected by the temperature sensor 35*a* and the calculated evaporating temperature is kept constant.

Similarly, the controller 60*b* in the heat medium relay unit 3 controls the opening degree of the expansion device 16*b* so that superheat (the degree of superheating) obtained as a temperature difference between the temperature detected by the temperature sensor 35*c* and the calculated evaporating temperature is kept constant.

The evaporating temperature may be determined on the basis of the circulation compositions transmitted from the controller 60*a* in the outdoor unit 1 and the temperature detected by the temperature sensor 35*b* (or temperature sensor 35*d*). That is, a saturated pressure and a saturated gas temperature may be calculated by assuming that the temperature detected by the temperature sensor 35*b* is a saturated liquid temperature or the temperature of a set quality, and an average temperature of the saturated liquid temperature and the saturated gas temperature may be calculated to determine an evaporating temperature. Then, the resulting evaporating temperature may be used to control the expansion devices 16*a* and 16*b*. In this case, the pressure sensor 36*a* and the pressure sensor 36*b* may not necessarily be installed, thus achieving a low-cost system.

Next, the flow of the heat medium in the heat medium circuit B will be described.

In the cooling only operation mode, cooling energy of the refrigerant is transferred to the heat medium in both the heat exchanger related to heat medium 15*a* and the heat exchanger related to heat medium 15*b*, and the chilled heat medium is caused by the pump 21*a* and the pump 21*b* to flow in the pipes 5.

The heat medium pressurized by and flowing out of the pump 21*a* flows into the heat exchanger related to heat medium 15*a* from the upper portion of the drawing through the heat medium passage reversing device 20*a*, and is chilled by the refrigerant flowing through the heat exchanger related to heat medium 15*a*. The chilled heat medium flows out of the heat exchanger related to heat medium 15*a* from the lower portion of the drawing, and flows through the heat medium passage reversing device 20*b*, reaching the first heat medium passage switching device 23*a* and the first heat medium passage switching device 23*b*. That is, the refrigerant and the heat medium, which flow through the heat exchanger related to heat medium 15*a*, are in counter flow relative to one another. The heat medium pressurized by and flowing out of the pump 21*b* flows into the heat exchanger related to heat medium 15*b* from the upper portion of the drawing through the heat medium passage reversing device 20*c*, and is chilled by the refrigerant flowing through the heat exchanger related to heat medium 15*b*. The chilled heat medium flows out of the heat exchanger related to heat medium 15*b* from the lower portion of drawing, and flows through the heat medium passage reversing device 20*d*, reaching the first heat medium passage switching device 23*a* and the first heat medium passage switching device 23*b*. That is, the refrigerant and the heat medium, which flow through the heat exchanger related to heat medium 15*b*, are in counter flow relative to one another.

Flows of the heat medium pumped out by the pump 21*a* and the pump 21*b* merge at each of the first heat medium passage switching device 23*a* and the first heat medium passage switching device 23*b*, and the merged flows of the heat medium enter the use side heat exchanger 26*a* and the use side heat exchanger 26*b*. Then, the flows of the heat medium absorb heat from the indoor air in the use side heat exchanger 26*a* and the use side heat exchanger 26*b* to cool the indoor space 7. Each of the use side heat exchanger 26*a* and the use side heat exchanger 26*b* serves as a cooler, and is configured such that the flow direction of the heat medium and the flow direction of the indoor air are in counter flow relative to one another.

The flows of the heat medium out of the use side heat exchanger 26*a* and the use side heat exchanger 26*b* enter the heat medium flow control device 25*a* and the heat medium flow control device 25*b*, respectively. At this time, due to the working of the heat medium flow control device 25*a* and the heat medium flow control device 25*b*, the flow rates of the flows of the heat medium are controlled to be flow rates necessary for the air conditioning load required indoors, and the resulting flows of the heat medium enter the use side heat exchanger 26*a* and the use side heat exchanger 26*b*. The flows of the heat medium out of the heat medium flow control device 25*a* and the heat medium flow control device 25*b* are split into flows at the second heat medium passage switching device 22*a* and the second heat medium passage switching device 22*b*, respectively, which are again sucked into the pump 21*a* and the pump 21*b*.

As described above, in the heat exchanger related to heat medium 15*a* and the heat exchanger related to heat medium 15*b*, the refrigerant flows from the lower portion of the drawing to the upper portion of the drawing, and the heat medium flows from the upper portion of the drawing to the lower portion of the drawing, so that the refrigerant and the heat medium are in counter flow relative to one another. Flowing of the refrigerant and the heat medium in a counter flow relative to one another manner provides good heat exchange efficiency and improves COP.

Further, if plate-type heat exchangers are used as the heat exchanger related to heat medium 15*a* and the heat exchanger related to heat medium 15*b*, flowing of the evaporation-side refrigerant from below to above in the manner illustrated in the drawing causes the evaporated gaseous refrigerant to move upward due to the buoyant force effect, yielding a reduction in the power of the compressor and appropriate distribution of the refrigerant. If plate-type heat exchangers are used as the heat exchanger related to heat medium 15*a* and the heat exchanger related to heat medium 15*b*, furthermore, flowing of the heat medium from above to below in the manner illustrated in the drawing causes the chilled heat medium to sink due to the gravitational effect, yielding a reduction in the power of the pumps, which is efficient.

In the pipes 5 of the use side heat exchangers 26, the heat medium flows in the direction from the first heat medium passage switching devices 23 to the second heat medium passage switching devices 22 through the heat medium flow control devices 25. Further, the air conditioning load required for the indoor space 7 can be compensated for by performing control to maintain the differences between the temperature detected by the temperature sensor 31*a* or the temperature detected by the temperature sensor 31*b* and the temperatures detected by the temperature sensors 34 at a target value. Either of the temperatures obtained by the temperature sensor 31*a* and the temperature sensor 31*b* may be used as the outlet temperatures of the heat exchangers related to heat medium 15, or an average temperature thereof may be used. At this time, the opening degrees of the second heat medium passage switching devices 22 and the first heat medium passage switching devices 23 are set to be an intermediate value so as to reserve the passages of the flows to both the heat exchanger related to heat medium 15*a* and the heat exchanger related to heat medium 15*b*.

In the cooling only operation mode, since it is not necessary to cause the heat medium to flow to a use side heat exchanger 26 having no heat load (including that in a thermostat-off state), the corresponding one of the heat medium flow control devices 25 closes the passage to prevent the heat medium from flowing to the use side heat exchanger 26. In FIG. 7, the heat medium is caused to flow to the use side heat exchanger 26*a* and the use side heat exchanger 26*b* because heat load is present there, whereas the use side heat exchanger 26*c* and the use side heat exchanger 26*d* have no heat load and the respectively associated heat medium flow control device 25*c* and heat medium flow control device 25*d* are fully closed. Once heat load is generated in the use side heat exchanger 26*c* or the use side heat exchanger 26*d*, the heat medium flow control device 25*c* or the heat medium flow control device 25*d* may be opened to allow the heat medium to circulate therein.

[Heating Only Operation Mode]

Figure 8:
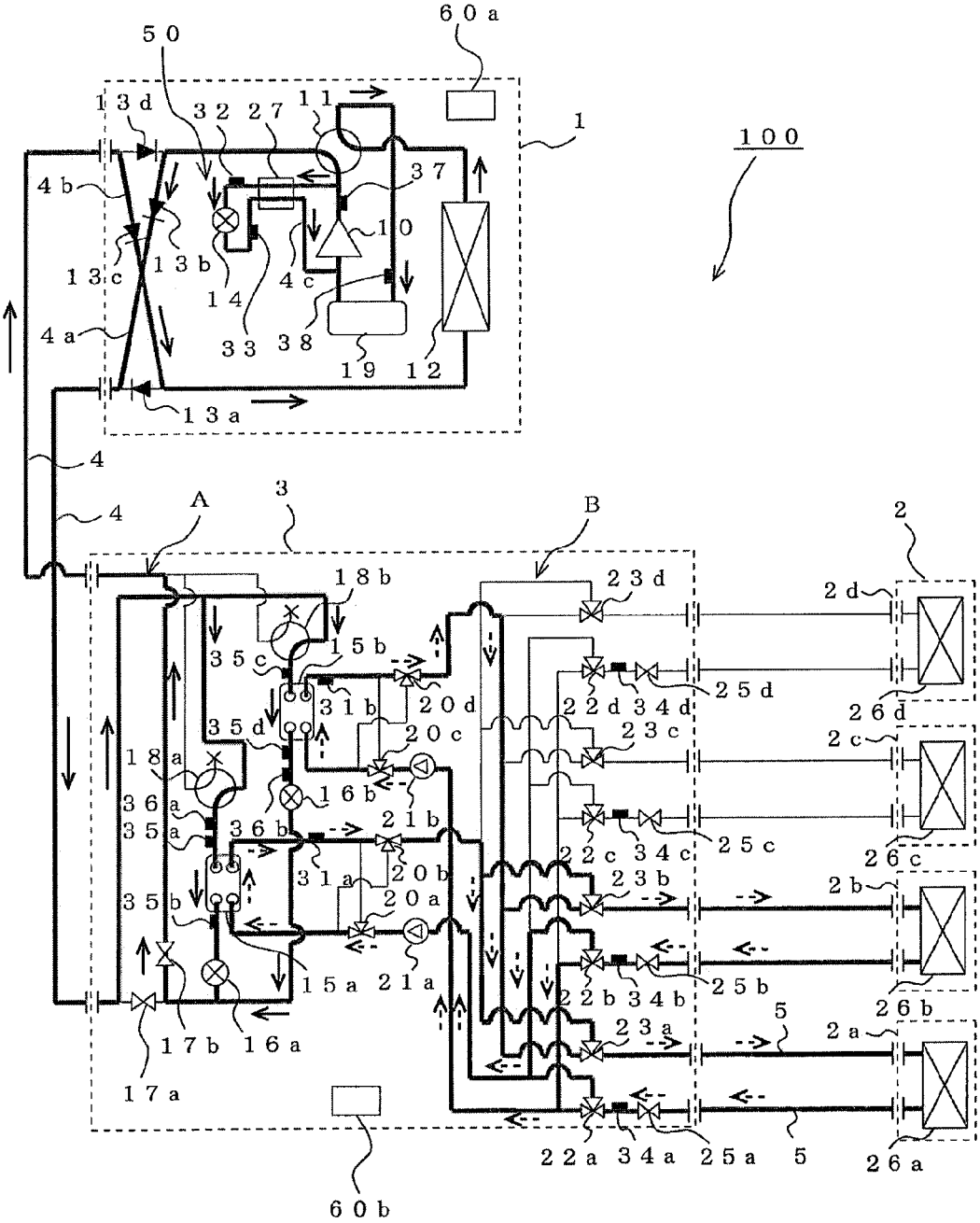
FIG. 8 is a system circuit diagram illustrating the flows of a refrigerant and a heat medium in a heating only operation mode of the air-conditioning apparatus according to Embodiment of the present invention.

FIG. 8 is a system circuit diagram illustrating the flows of the refrigerant and the heat medium in the heating only operation mode of the air-conditioning apparatus according to Embodiment of the present invention. Referring to FIG. 8, a description will be given of the heating only operation mode, taking an example where heating energy load is generated only in the use side heat exchanger 26*a* and the use side heat exchanger 26*b*. In FIG. 8, pipes indicated by thick lines represent pipes through which the refrigerant and the heat medium flow. In FIG. 8, furthermore, the direction of the flow of the refrigerant is indicated by solid line arrows, and the direction of the flow of the heat medium is indicated by broken line arrows.

In the heating only operation mode illustrated in FIG. 8, in the outdoor unit 1, the first refrigerant passage switching device 11 is switched so as to cause the refrigerant discharged from the compressor 10 to flow into the heat medium relay unit 3 without flowing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed so that the heat medium circulates between each of the heat exchanger related to heat medium 15*a* and the heat exchanger related to heat medium 15*b* and the use side heat exchanger 26*a* and between each of the heat exchanger related to heat medium 15*a* and the heat exchanger related to heat medium 15*b* and the use side heat exchanger 26*b*. In the heat medium relay unit 3, furthermore, the opening and closing device 17*a* is closed and the opening and closing device 17*b* is opened.

First, the flow of the refrigerant in the refrigerant circuit A will be described.

A low-temperature and low-pressure refrigerant is compressed by the compressor 10 into a high-temperature and high-pressure gaseous refrigerant, which is then discharged. The high-temperature and high-pressure gaseous refrigerant discharged from the compressor 10 flows through the first refrigerant passage switching device 11, passing through the first connecting pipe 4*a*, and flows out of the outdoor unit 1 through the check valve 13*b*. The high-temperature and high-pressure gaseous refrigerant flowing out of the outdoor unit 1 flows into the heat medium relay unit 3 through the refrigerant pipe 4. The flow of the high-temperature and high-pressure gaseous refrigerant flowing into the heat medium relay unit 3 branches into flows, which enter the heat exchanger related to heat medium 15*a* and the heat exchanger related to heat medium 15*b* through the second refrigerant passage switching device 18*a* and the second refrigerant passage switching device 18*b*, respectively.

The high-temperature and high-pressure gaseous refrigerant flows into the heat exchangers related to heat medium 15*a* and 15*b* serving as condensers (heaters) from the upper portion of the drawing, and is condensed and liquefied, while transferring heat to the heat medium circulating in the heat medium circuit B, into a high-pressure liquid refrigerant. The liquid refrigerants flowing out of the heat exchanger related to heat medium 15*a* and the heat exchanger related to heat medium 15*b* from the lower portion of the drawing are expanded by the expansion device 16*a* and the expansion device 16*b*, respectively, into a low-temperature and low-pressure two-phase refrigerant. The two-phase refrigerant flows out of the heat medium relay unit 3 through the opening and closing device 17*b*, and again flows into the outdoor unit 1 along the refrigerant pipe 4. The refrigerant flowing into the outdoor unit 1 passes through the second connecting pipe 4*b*, and flows into the heat source side heat exchanger 12 serving as an evaporator through the check valve 13*c*.

Then, the refrigerant flowing into the heat source side heat exchanger 12 absorbs heat from outdoor air in the heat source side heat exchanger 12, and is turned into a low-temperature and low-pressure gaseous refrigerant. The low-temperature and low-pressure gaseous refrigerant flowing out of the heat source side heat exchanger 12 is again sucked into the compressor 10 through the first refrigerant passage switching device 11 and the accumulator 19.

The circulation compositions of the refrigerant circulating in the refrigerant circuit A are measured by using the refrigerant circulation composition detection device 50 (the high-low pressure bypass pipe 4*c*, the expansion device 14, the refrigerant-refrigerant heat exchanger 27, the high-pressure side refrigerant temperature detection device 32, the low-pressure side refrigerant temperature detection device 33, the high-pressure side pressure detection device 37, and the low-pressure side pressure detection device 38). The controller 60*a* in the outdoor unit 1 and the controller 60*b* in the heat medium relay unit 3 are connected via wire or wirelessly so as to be capable of communicating with each other, and the circulation compositions calculated by the controller 60*a* in the outdoor unit 1 are transmitted via communication from the controller 60*a* in the outdoor unit 1 to the controller 60*b* in the heat medium relay unit 3.

The controller 60*b* in the heat medium relay unit 3 calculates a saturated liquid temperature and a saturated gas temperature on the basis of the circulation compositions transmitted from the controller 60*a* in the outdoor unit 1 and the pressure detected by the pressure sensor 36*b*. Further, the controller 60*b* in the heat medium relay unit 3 calculates an average temperature of the saturated liquid temperature and the saturated gas temperature to determine a condensing temperature. Then, the controller 60*b* in the heat medium relay unit 3 controls the opening degree of the expansion device 16*a* so that subcool (degree of subcooling) obtained as a temperature difference between the temperature detected by the temperature sensor 35*b* and the calculated condensing temperature is kept constant.

Similarly, the controller 60*b* in the heat medium relay unit 3 controls the opening degree of the expansion device 16*b* so that subcool (degree of subcooling) obtained as a temperature difference between the temperature detected by the temperature sensor 35*d* and the calculated condensing temperature.

Next, the flow of the heat medium in the heat medium circuit B will be described.

In the heating only operation mode, heating energy of the refrigerant is transferred to the heat medium in both the heat exchanger related to heat medium 15*a* and the heat exchanger related to heat medium 15*b*, and the warmed heat medium is caused by the pump 21*a* and the pump 21*b* to flow in the pipes 5.

The heat medium pressurized by and flowing out of the pump 21*a* flows into the heat exchanger related to heat medium 15*a* from the lower portion of the drawing through the heat medium passage reversing device 20*a*, and is warmed by the refrigerant flowing through the heat exchanger related to heat medium 15*a*. The warmed heat medium flows out of the heat exchanger related to heat medium 15*a* from the upper portion of the drawing, and flows through the heat medium passage reversing device 20*b*, reaching the first heat medium passage switching device 23*a* and the first heat medium passage switching device 23*b*. That is, in the heating only operation heat mode, switching of the heat medium passage reversing device 20*a* and the heat medium passage reversing device 20*b* makes the direction of the heat medium flowing through the heat exchanger related to heat medium 15*a* opposite to that in the cooling only operation mode, and makes the refrigerant and the heat medium, which flow through the heat exchanger related to heat medium 15*a*, be in counter flow relative to one another. The heat medium pressurized by and flowing out of the pump 21*b* flows into the heat exchanger related to heat medium 15*b* from the lower portion of the drawing through the heat medium passage reversing device 20*c*, and is warmed by the refrigerant flowing through the heat exchanger related to heat medium 15*b*. The warmed heat medium flows out of the heat exchanger related to heat medium 15*b* from the upper portion of the drawing, and flows through the heat medium passage reversing device 20*d*, reaching the first heat medium passage switching device 23*a* and the first heat medium passage switching device 23*b*. That is, in the heating only operation heat mode, switching of the medium passage reversing device 20*c* and the heat medium passage reversing device 20*d* makes the direction of the heat medium flowing through the heat exchanger related to heat medium 15*b* opposite to that in the cooling only operation mode, and makes the refrigerant and the heat medium, which flow through the heat exchanger related to heat medium 15*b*, be in counter flow relative to one another.

The flows of the heat medium pumped out by the pump 21*a* and the pump 21*b* merge at each of the first heat medium passage switching device 23*a* and the first heat medium passage switching device 23*b*, and the merged flows of the heat medium enter the use side heat exchanger 26*a* and the use side heat exchanger 26*b*. Then, the flows of the heat medium transfer heat to indoor air in the use side heat exchanger 26*a* and use side heat exchanger 26*b* to heat the indoor space 7. Each of the use side heat exchanger 26*a* and the use side heat exchanger 26*b* serves as a heater, and is configured such that the flow direction of the heat medium is the same as that in the case where it serves as a cooler and the flow direction of the heat medium and the flow direction of the indoor air are counter to one another.

The flows of the heat medium out of the use side heat exchanger 26*a* and the use side heat exchanger 26*b* enter the heat medium flow control device 25*a* and the heat medium flow control device 25*b*, respectively. At this time, due to the working of the heat medium flow control device 25*a* and the heat medium flow control device 25*b*, the flow rates of the flows of the heat medium are controlled to be flow rates necessary to compensate for the air conditioning load required indoor, and the resulting flows of the heat medium enter the use side heat exchanger 26*a* and the use side heat exchanger 26*b*. The flows of the heat medium out of the heat medium flow control device 25*a* and the heat medium flow control device 25*b* are split into flows at the second heat medium passage switching device 22*a* and the second heat medium passage switching device 22*b*, respectively, which are again sucked into the pump 21*a* and the pump 21*b*.

As described above, in the heat exchanger related to heat medium 15*a* and the heat exchanger related to heat medium 15*b*, the refrigerant flows from the upper portion of the drawing to the lower portion of the drawing, and the heat medium flows from the lower portion of the drawing to the upper portion of the drawing, where the refrigerant and the heat medium are in counter flow relative to one another. Flowing of the refrigerant and the heat medium in a counter flow relative to one another manner provides good heat exchange efficiency and improves COP.

Further, if plate-type heat exchangers are used as the heat exchanger related to heat medium 15*a* and the heat exchanger related to heat medium 15*b*, flowing of the condensing-side refrigerant from above to below in the manner illustrated in the drawing causes the condensed liquid refrigerant to move downward due to the gravitational effect, yielding a reduction in the power of the compressor. If plate-type heat exchangers are used as the heat exchanger related to heat medium 15*a* and the heat exchanger related to heat medium 15*b*, furthermore, flowing of the heat medium from below to above in the manner illustrated in the drawing causes the warmed heat medium to float due to the buoyant force effect, yielding a reduction in the power of the pumps, which is efficient.

In the pipes 5 of the use side heat exchangers 26, the heat medium flows in the direction from the first heat medium passage switching devices 23 to the second heat medium passage switching devices 22 through the heat medium flow control devices 25. Further, the air conditioning load required for the indoor space 7 can be compensated for by performing control to maintain the differences between the temperature detected by the temperature sensor 31*a* or the temperature detected by the temperature sensor 31*b* and the temperatures detected by the temperature sensors 34 at a target value. Either of the temperatures obtained by the temperature sensor 31*a* and the temperature sensor 31*b* may be used as the outlet temperatures of the heat exchangers related to heat medium 15, or an average temperature thereof may be used.

At this time, the opening degrees of the second heat medium passage switching devices 22 and the first heat medium passage switching devices 23 are set to be an intermediate value so as to reserve the passages of the flows to both the heat exchanger related to heat medium 15*a* and the heat exchanger related to heat medium 15*b*. Furthermore, the flow rates of the flows of the heat medium flowing through the use side heat exchangers 26 should be controlled using the temperature differences between the inlet and outlet temperatures. The temperatures of the flows of the heat medium on the inlet side of the use side heat exchangers 26 are substantially the same as the temperatures detected by the temperature sensors 31. Thus, the number of temperature sensors can be reduced by controlling the flow rates of the flows of the heat medium flowing through the use side heat exchangers 26 using the temperatures detected by the temperature sensors 31, thus achieving a low-cost system.

In the heating only operation mode, since it is not necessary to cause the heat medium to flow to a use side heat exchanger 26 having no heat load (including that in a thermostat-off state), the corresponding one of the heat medium flow control devices 25 closes the passage to prevent the heat medium from flowing to the use side heat exchanger 26. In FIG. 8, the heat medium is caused to flow to the use side heat exchanger 26*a* and the use side heat exchanger 26*b* because heat load is present, whereas the use side heat exchanger 26*c* and the use side heat exchanger 26*d* have no heat load and the respectively associated heat medium flow control device 25*c* and heat medium flow control device 25*d* are fully closed. Once heat load is generated in the use side heat exchanger 26*c* or the use side heat exchanger 26*d*, the heat medium flow control device 25*c* or the heat medium flow control device 25*d* may be opened to allow the heat medium to circulate therein.

[Cooling Main Operation Mode]

Figure 9:
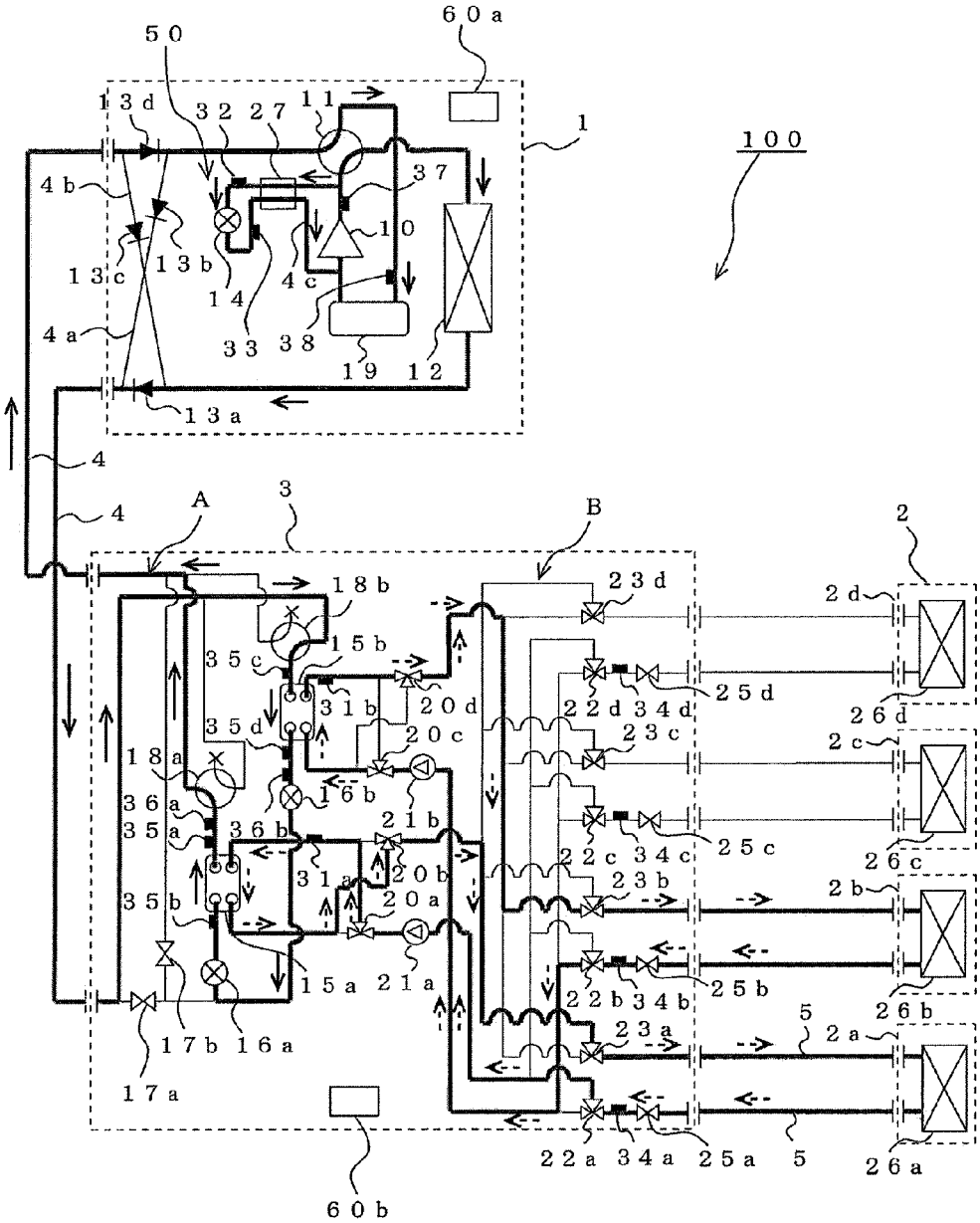
FIG. 9 is a system circuit diagram illustrating the flows of a refrigerant and a heat medium in a cooling main operation mode of the air-conditioning apparatus according to Embodiment of the present invention.

FIG. 9 is a system circuit diagram illustrating the flows of the refrigerant and the heat medium in the cooling main operation mode of the air-conditioning apparatus according to Embodiment of the present invention. Referring to FIG. 9, a description will be given of the cooling main operation mode, taking an example where cooling energy load is generated in the use side heat exchanger 26*a* and heating energy load is generated in the use side heat exchanger 26*b*. In FIG. 9, pipes indicated by thick lines represent pipes through which the refrigerant and the heat medium circulate. In FIG. 9, furthermore, the direction of the flow of the refrigerant is indicated by solid line arrows, and the direction of the flow of the heat medium is indicated by broken line arrows.

In the cooling main operation mode illustrated in FIG. 9, in the outdoor unit 1, the first refrigerant passage switching device 11 is switched so as to cause the refrigerant discharged from the compressor 10 to flow into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed so that the heat medium circulates between the heat exchanger related to heat medium 15*a* and the use side heat exchanger 26*a* and between the heat exchanger related to heat medium 15*b* and the use side heat exchanger 26*b*. In the heat medium relay unit 3, furthermore, the opening and closing device 17*a* and the opening and closing device 17*b* are closed.

First, the flow of the refrigerant in the refrigerant circuit A will be described.

A low-temperature and low-pressure refrigerant is compressed by the compressor 10 into a high-temperature and high-pressure gaseous refrigerant, which is then discharged. The high-temperature and high-pressure gaseous refrigerant discharged from the compressor 10 flows into the heat source side heat exchanger 12 through the first refrigerant passage switching device 11. Then, the gaseous refrigerant is condensed, while transferring heat to outdoor air in the heat source side heat exchanger 12, into a two-phase refrigerant. The two-phase refrigerant flowing out of the heat source side heat exchanger 12 flows out of the outdoor unit 1 through the check valve 13*a*, and flows into the heat medium relay unit 3 through the refrigerant pipe 4. The two-phase refrigerant flowing into the heat medium relay unit 3 flows into the heat exchanger related to heat medium 15*b* serving as a condenser through the second refrigerant passage switching device 18*b*.

The two-phase refrigerant flows into the heat exchanger related to heat medium 15*b* serving as a condenser from the upper portion of the drawing, and is condensed and liquefied, while transferring heat to the heat medium circulating in the heat medium circuit B, into a liquid refrigerant. The liquid refrigerant flowing out of the heat exchanger related to heat medium 15*b* from the lower portion of the drawing is expanded by the expansion device 16*b* into a low-pressure two-phase refrigerant. The low-pressure two-phase refrigerant flows into the heat exchanger related to heat medium 15*a* serving as an evaporator through the expansion device 16*a*. The low-pressure two-phase refrigerant flowing into the heat exchanger related to heat medium 15*a* from the lower portion of the drawing absorbs heat from the heat medium circulating in the heat medium circuit B to cool the heat medium, so that the two-phase refrigerant is turned into a low-pressure gaseous refrigerant. The gaseous refrigerant flows out of the heat exchanger related to heat medium 15*a* from the upper portion of the drawing, flows out of the heat medium relay unit 3 through the second refrigerant passage switching device 18*a*, and again flows into the outdoor unit 1 along the refrigerant pipe 4. The refrigerant flowing into the outdoor unit 1 flows through the check valve 13*d*, and is again sucked into the compressor 10 through the first refrigerant passage switching device 11 and the accumulator 19.

The circulation compositions of the refrigerant circulating in the refrigerant circuit A are measured by using the refrigerant circulation composition detection device 50 (the high-low pressure bypass pipe 4*c*, the expansion device 14, the refrigerant-refrigerant heat exchanger 27, the high-pressure side refrigerant temperature detection device 32, the low-pressure side refrigerant temperature detection device 33, the high-pressure side pressure detection device 37, and the low-pressure side pressure detection device 38). The controller 60*a* in the outdoor unit 1 and the controller 60*b* in the heat medium relay unit 3 are connected via wire or wirelessly so as to be capable of communicating with each other, and the circulation compositions calculated by the controller 60*a* in the outdoor unit 1 are transmitted via communication from the controller 60*a* in the outdoor unit 1 to the controller 60*b* in the heat medium relay unit 3.

The controller 60*b* in the heat medium relay unit 3 calculates a saturated liquid temperature and a saturated gas temperature on the basis of the circulation compositions transmitted from the controller 60*a* in the outdoor unit 1 and the pressure detected by the pressure sensor 36*a*. Further, the controller 60*b* in the heat medium relay unit 3 calculates an average temperature of the saturated liquid temperature and the saturated gas temperature to determine an evaporating temperature of the heat exchanger related to heat medium 15*a*. Then, the controller 60*b* in the heat medium relay unit 3 controls the opening degree of the expansion device 16*b* so that superheat (degree of superheating) obtained as a temperature difference between the temperature detected by the temperature sensor 35*a* and the calculated evaporating temperature is kept constant. In addition, the expansion device 16*a* is fully opened.

The controller 60*b* in the heat medium relay unit 3 may calculate a saturated liquid temperature and a saturated gas temperature on the basis of the circulation compositions transmitted from the controller 60*a* in the outdoor unit 1 and the pressure detected by the pressure sensor 36*b*. Then, the controller 60*b* in the heat medium relay unit 3 may calculate an average temperature of the saturated liquid temperature and the saturated gas temperature to determine a condensing temperature, and may control the opening degree of the expansion device 16*b* so that subcool (degree of subcooling) obtained as a temperature difference between the temperature detected by the temperature sensor 35*d* and the calculated condensing temperature is kept constant. In addition, the expansion device 16*b* may be fully opened and the expansion device 16*a* may be used to control superheat or subcool.

A saturated pressure and a saturated gas temperature may be calculated by assuming that the temperature detected by the temperature sensor 35*b* is a saturated liquid temperature or the temperature of a set quality on the basis of the circulation compositions transmitted via communication from the outdoor unit 1 and the temperature sensor 35*b*, and an average temperature of the saturated liquid temperature and the saturated gas temperature may be calculated to determine an evaporating temperature. Then, the determined evaporating temperature may be used to control the expansion devices 16*a* and 16*b*. In this case, the installation of the pressure sensor 36*a* may be omitted, thus achieving a low-cost system.

Next, the flow of the heat medium in the heat medium circuit B will be described.

In the cooling main operation mode, heating energy of the refrigerant is transferred to the heat medium in the heat exchanger related to heat medium 15*b*, and the warmed heat medium is caused by the pump 21*b* to flow in the pipes 5. In the cooling main operation mode, furthermore, cooling energy of the refrigerant is transferred to the heat medium in the heat exchanger related to heat medium 15*a*, and the chilled heat medium is caused by the pump 21*a* to flow in the pipes 5.

The heat medium pressurized by and flowing out of the pump 21*b* flows into the heat exchanger related to heat medium 15*b* from the lower portion of the drawing through the heat medium passage reversing device 20*c*, and is warmed by the refrigerant flowing through the heat exchanger related to heat medium 15*b*. The warmed heat medium flows out of the heat exchanger related to heat medium 15*b* from the upper portion of the drawing, and flows through the heat medium passage reversing device 20*d*, reaching the first heat medium passage switching device 23*b*. That is, in other words, switching of the medium passage reversing device 20*c* and the heat medium passage reversing device 20*d* makes the refrigerant and the heat medium, which flow through the heat exchanger related to heat medium 15*b*, be in counter flow relative to one another. The heat medium pressurized by and flowing out of the pump 21*a* flows into the heat exchanger related to heat medium 15*a* from the upper portion of the drawing through the heat medium passage reversing device 20*a*, and is chilled by the refrigerant flowing through the heat exchanger related to heat medium 15*a*. The chilled heat medium flows out of the heat exchanger related to heat medium 15*a* from the lower portion of the drawing, and flows through the heat medium passage reversing device 20*b*, reaching the first heat medium passage switching device 23*a*. That is, switching of the heat medium passage reversing device 20*a* and the heat medium passage reversing device 20*b* makes the refrigerant and the heat medium, which flow through the heat exchanger related to heat medium 15*a*, be in counter flow relative to one another.

The heat medium having passed through the first heat medium passage switching device 23*b* flows into the use side heat exchanger 26*b*, and transfers heat to indoor air to heat the indoor space 7. Further, the heat medium having passed through the first heat medium passage switching device 23*a* flows into the use side heat exchanger 26*a*, and absorbs heat from indoor air to cool the indoor space 7. At this time, due to the working of the heat medium flow control device 25*a* and the heat medium flow control device 25*b*, the flow rates of the flows of the heat medium are controlled to be flow rates necessary to compensate for the air conditioning load required indoor, and the resulting flows of the heat medium enter the use side heat exchanger 26*a* and the use side heat exchanger 26*b*. The heat medium, whose temperature has been slightly reduced after having passed through the use side heat exchanger 26*b*, passes through the heat medium flow control device 25*b* and the second heat medium passage switching device 22*b*, and is again sucked into the pump 21*b*. The heat medium, whose temperature has been slightly increased after having passed through the use side heat exchanger 26*a*, passes through the heat medium flow control device 25*a* and the second heat medium passage switching device 22*a*, and is again sucked into the pump 21*a*. While the use side heat exchanger 26*a* serves as a cooler and the use side heat exchanger 26*b* serves as a heater, both are configured such that the flow direction of the heat medium and the flow direction of the indoor air are counter to one another.

During this period, the hot heat medium and the cold heat medium are not mixed due to the working of the second heat medium passage switching devices 22 and the first heat medium passage switching devices 23, and are introduced into a use side heat exchanger 26 having a heating energy load and a use side heat exchanger 26 having a cooling energy load, respectively. In the pipes 5 of the use side heat exchangers 26, the heat medium flows in the direction from the first heat medium passage switching devices 23 to the second heat medium passage switching devices 22 through the heat medium flow control devices 25 on both the heating side and the cooling side. Further, the air conditioning load required for the indoor space 7 can be compensated for by performing control to maintain the differences between the temperature detected by the temperature sensor 31*b* and the temperatures detected by the temperature sensors 34 on the heating side or between the temperatures detected by the temperature sensors 34 and the temperature detected by the temperature sensor 31*a* on the cooling side at a target value.

As described above, in the heat exchanger related to heat medium 15*a* serving as a cooler, the refrigerant flows from the lower portion of the drawing to the upper portion of the drawing, and the heat medium flows from the upper portion of the drawing to the lower portion of the drawing, where the refrigerant and the heat medium are in counter flow relative to one another. Further, in the heat exchanger related to heat medium 15*b* serving as a heater, the refrigerant flows from the upper portion of the drawing to the lower portion of the drawing, and the heat medium flows from the lower portion of the drawing to the upper portion of the drawing, such that the refrigerant and the heat medium are in counter flow relative to one another. Flowing of the refrigerant and the heat medium in a counter flow relative to one another manner provides good heat exchange efficiency and improves COP.

Further, if a plate-type heat exchanger is used as the heat exchanger related to heat medium 15*a* serving as a cooler, flowing of the evaporation-side refrigerant from below to above in the manner illustrated in the drawing causes the evaporated gaseous refrigerant to move upward due to the buoyant force effect, yielding a reduction in the power of the compressor and appropriate distribution of the refrigerant. If a plate-type heat exchanger is used as the heat exchanger related to heat medium 15*a* serving as a cooler, furthermore, flowing of the heat medium from above to below in the manner illustrated in the drawing causes the chilled heat medium to sink due to the gravitational effect, yielding a reduction in the power of the pump, which is efficient.

Further, if a plate-type heat exchanger is used as the heat exchanger related to heat medium 15*b* serving as a heater, flowing of the condensing-side refrigerant from above to below in the manner illustrated in the drawing causes the condensed liquid refrigerant to move downward due to the gravitational effect, yielding a reduction in the power of the compressor. If a plate-type heat exchanger is used as the heat exchanger related to heat medium 15*b* serving as a heater, furthermore, flowing of the heat medium from below to above in the manner illustrated in the drawing causes the warmed heat medium to float due to the buoyant force effect, yielding a reduction in the power of the pumps, which is efficient.

In the cooling main operation mode, since it is not necessary to cause the heat medium to flow to a use side heat exchanger 26 having no heat load (including that in a thermostat-off state), the corresponding one of the heat medium flow control devices 25 closes the passage to prevent the heat medium from flowing to the use side heat exchanger 26. In FIG. 9, the heat medium is caused to flow to the use side heat exchanger 26*a* and the use side heat exchanger 26*b* because heat load is present, whereas the use side heat exchanger 26*c* and the use side heat exchanger 26*d* have no heat load and the respectively associated heat medium flow control device 25*c* and heat medium flow control device 25*d* are fully closed. Once heat load is generated in the use side heat exchanger 26*c* or the use side heat exchanger 26*d*, the heat medium flow control device 25*c* or the heat medium flow control device 25*d* may be opened to allow the heat medium to circulate therein.

[Heating Main Operation Mode]

Figure 10:
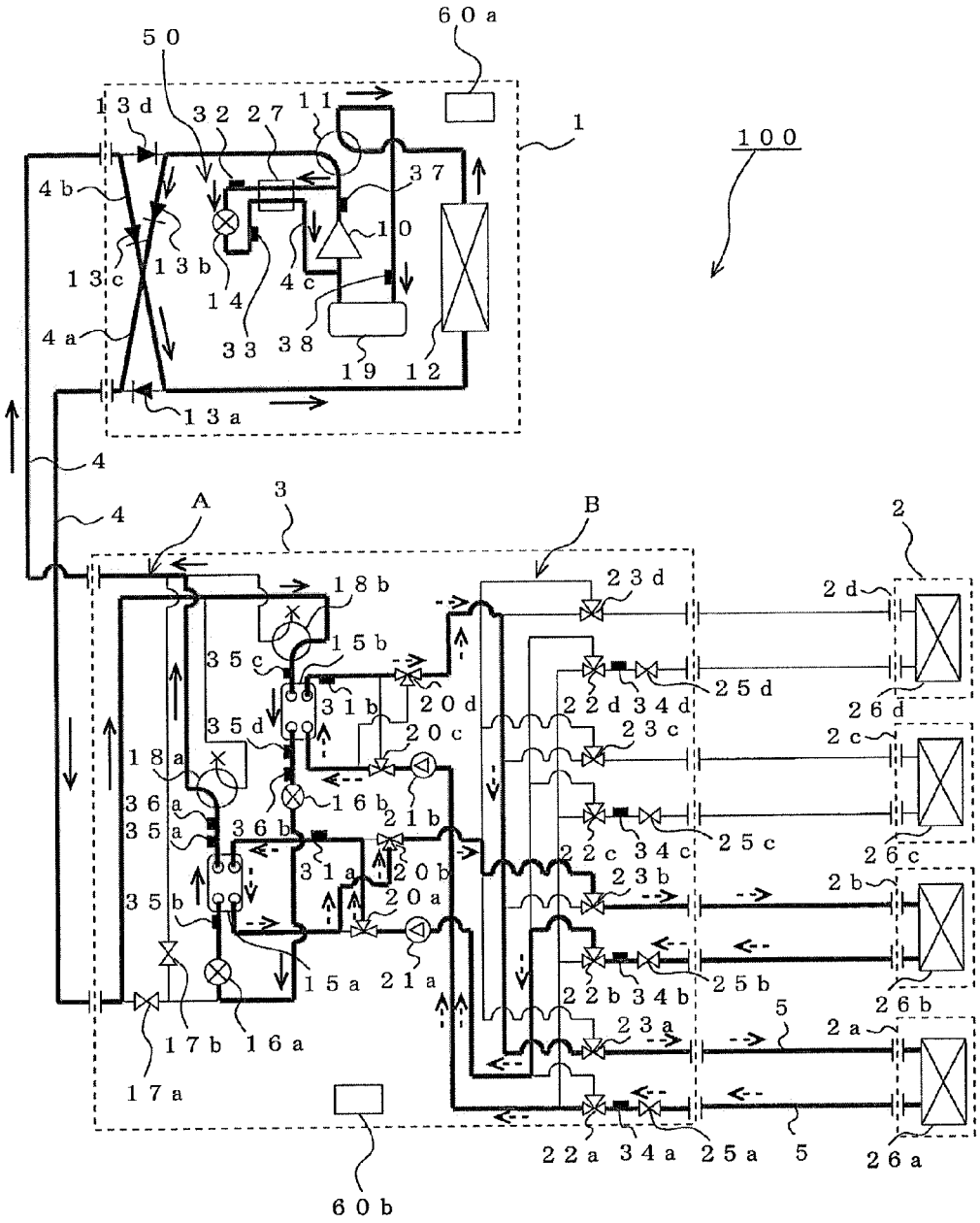
FIG. 10 is a system circuit diagram illustrating the flows of a refrigerant and a heat medium in a heating main operation mode of the air-conditioning apparatus according to Embodiment of the present invention.

FIG. 10 is a system circuit diagram illustrating the flows of the refrigerant and the heat medium in the heating main operation mode of the air-conditioning apparatus according to Embodiment of the present invention. Referring to FIG. 10, a description will be given of the heating main operation mode, taking an example where heating energy load is generated in the use side heat exchanger 26*a* and cooling energy load is generated in the use side heat exchanger 26*b*. In FIG. 10, pipes indicated by thick lines represent pipes through which the refrigerant and the heat medium circulate. In FIG. 10, furthermore, the direction of the flow of the refrigerant is indicated by solid line arrows, and the direction of the flow of the heat medium is indicated by broken line arrows.

In the heating main operation mode illustrated in FIG. 10, in the outdoor unit 1, the first refrigerant passage switching device 11 is switched so as to cause the refrigerant discharged from the compressor 10 to flow into the heat medium relay unit 3 without flowing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed so that the heat medium circulates between each of the heat exchanger related to heat medium 15*a* and the heat exchanger related to heat medium 15*b* and the use side heat exchanger 26*a* and between each of the heat exchanger related to heat medium 15*a* and the heat exchanger related to heat medium 15*b* and the use side heat exchanger 26*b*. In the heat medium relay unit 3, furthermore, the opening and closing device 17*a* and the opening and closing device 17*b* are closed.

First, the flow of the refrigerant in the refrigerant circuit A will be described.

A low-temperature and low-pressure refrigerant is compressed by the compressor 10 into a high-temperature and high-pressure gaseous refrigerant, which is then discharged. The high-temperature and high-pressure gaseous refrigerant discharged from the compressor 10 flows through the first refrigerant passage switching device 11, passing through the first connecting pipe 4*a*, and flows out of the outdoor unit 1 through the check valve 13*b*. The high-temperature and high-pressure gaseous refrigerant flowing out of the outdoor unit 1 flows into the heat medium relay unit 3 through the refrigerant pipe 4. The high-temperature and high-pressure gaseous refrigerant flowing into the heat medium relay unit 3 flows into the heat exchanger related to heat medium 15*b* serving as a condenser through the second refrigerant passage switching device 18*b*.

The gaseous refrigerant flows into the heat exchanger related to heat medium 15*b* serving as a condenser from the upper portion of the drawing, and is condensed and liquefied into a liquid refrigerant, while transferring heat to the heat medium circulating in the heat medium circuit B. The liquid refrigerant flowing out of the heat exchanger related to heat medium 15*b* is expanded by the expansion device 16*b* into a low-pressure two-phase refrigerant. The low-pressure two-phase refrigerant flows into the heat exchanger related to heat medium 15*a* serving as an evaporator through the expansion device 16*a*. The low-pressure two-phase refrigerant flowing into the heat exchanger related to heat medium 15*a* from the lower portion of the drawing evaporates by removing heat from the heat medium circulating in the heat medium circuit B, and cools the heat medium. The low-pressure gaseous refrigerant flows out of the heat exchanger related to heat medium 15*a* from the upper portion of the drawing, flows out of the heat medium relay unit 3 through the second refrigerant passage switching device 18*a*, and again flows into the outdoor unit 1 along the refrigerant pipe 4.

The refrigerant flowing into the outdoor unit 1 passes through the second connecting pipe 4*b*, and flows into the heat source side heat exchanger 12 serving as an evaporator through the check valve 13*c*. Then, the refrigerant flowing into the heat source side heat exchanger 12 absorbs heat from outdoor air in the heat source side heat exchanger 12, and is turned into a low-temperature and low-pressure gaseous refrigerant. The low-temperature and low-pressure gaseous refrigerant flowing out of the heat source side heat exchanger 12 is again sucked into the compressor 10 through the first refrigerant passage switching device 11 and the accumulator 19.

The controller 60*b* in the heat medium relay unit 3 calculates a saturated liquid temperature and a saturated gas temperature on the basis of the circulation compositions transmitted from the controller 60*a* in the outdoor unit 1 and the pressure detected by the pressure sensor 36*b*. Further, the controller 60*b* in the heat medium relay unit 3 calculates an average temperature of the saturated liquid temperature and the saturated gas temperature to determine a condensing temperature. Then, the controller 60*b* in the heat medium relay unit 3 controls the opening degree of the expansion device 16*b* so that subcool (degree of subcooling) obtained as a temperature difference between the temperature detected by the temperature sensor 35*d* and the calculated condensing temperature is kept constant. At this time, the expansion device 16*a* is fully opened. Note that the expansion device 16*b* may be fully opened and the expansion device 16*a* may be used to control subcool.

A saturated pressure and a saturated gas temperature may be calculated by assuming that the temperature detected by the temperature sensor 35*b* is a saturated liquid temperature or the temperature of a set quality on the basis of the circulation compositions transmitted via communication from the outdoor unit 1 and the temperature sensor 35*b*, and an average temperature of the saturated liquid temperature and the saturated gas temperature may be calculated to determine an evaporating temperature. Then, the determined evaporating temperature may be used to control the expansion devices 16*a* and 16*b*. In this case, the installation of the pressure sensor 36*a* may be omitted, thus achieving a low-cost system.

Next, the flow of the heat medium in the heat medium circuit B will be described.

In the heating main operation mode, heating energy of the refrigerant is transferred to the heat medium in the heat exchanger related to heat medium 15*b*, and the warmed heat medium is caused by the pump 21*b* to flow in the pipes 5. In the heating main operation mode, furthermore, cooling energy of the refrigerant is transferred to the heat medium in the heat exchanger related to heat medium 15*a*, and the chilled heat medium is caused by the pump 21*a* to flow in the pipes 5.

The heat medium pressurized by and flowing out of the pump 21*b* flows into the heat exchanger related to heat medium 15*b* from the lower portion of the drawing through the heat medium passage reversing device 20*c*, and is warmed by the refrigerant flowing through the heat exchanger related to heat medium 15*b*. The warmed heat medium flows out of the heat exchanger related to heat medium 15*b* from the upper portion of the drawing, and flows through the heat medium passage reversing device 20*d*, reaching the first heat medium passage switching device 23*a*. That is, switching of the medium passage reversing device 20*c* and the heat medium passage reversing device 20*d* makes the refrigerant and the heat medium, which flow through the heat exchanger related to heat medium 15*b*, be in counter flow relative to one another. The heat medium pressurized by and flowing out of the pump 21*a* flows into the heat exchanger related to heat medium 15*a* from the upper portion of the drawing through the heat medium passage reversing device 20*a*, and is chilled by the refrigerant flowing through the heat exchanger related to heat medium 15*a*. The chilled heat medium flows out of the heat exchanger related to heat medium 15*a* from the lower portion of the drawing, and flows through the heat medium passage reversing device 20*b*, reaching the first heat medium passage switching device 23*b*. That is, switching of the heat medium passage reversing device 20*a* and the heat medium passage reversing device 20*b* makes the refrigerant and the heat medium, which flow through the heat exchanger related to heat medium 15*a*, be in counter flow relative to one another.

The heat medium having passed through the first heat medium passage switching device 23*a* flows into the use side heat exchanger 26*a*, and transfers heat to indoor air to heat the indoor space 7. Further, the heat medium having passed through the first heat medium passage switching device 23*b* flows into the use side heat exchanger 26*b*, and absorbs heat from indoor air to cool the indoor space 7. At this time, due to the working of the heat medium flow control device 25*a* and the heat medium flow control device 25*b*, the flow rates of the flows of the heat medium are controlled to be flow rates necessary to compensate for the air conditioning load required indoor, and the resulting flows of the heat medium enter the use side heat exchanger 26*a* and the use side heat exchanger 26*b*. The heat medium, whose temperature has been slightly reduced after having passed through the use side heat exchanger 26*a*, passes through the heat medium flow control device 25*a* and the second heat medium passage switching device 22*a*, and is again sucked into the pump 21*b*. The heat medium, whose temperature has been slightly increased after having passed through the use side heat exchanger 26*b*, passes through the heat medium flow control device 25*b* and the second heat medium passage switching device 22*b*, and is again sucked into the pump 21*a*. While the use side heat exchanger 26*a* serves as a heater and the use side heat exchanger 26*b* serves as a cooler, both are configured such that the flow direction of the heat medium and the flow direction of the indoor air are counter to one another.

During this period, the hot heat medium and the cold heat medium are not mixed due to the working of the second heat medium passage switching devices 22 and the first heat medium passage switching devices 23, and are introduced into a use side heat exchanger 26 having a heating energy load and a use side heat exchanger 26 having a cooling energy load, respectively. In the pipes 5 of the use side heat exchangers 26, the heat medium flows in the direction from the first heat medium passage switching devices 23 to the second heat medium passage switching devices 22 through the heat medium flow control devices 25 on both the heating side and the cooling side. Further, the air conditioning load required for the indoor space 7 can be compensated for by performing control to maintain the differences between the temperature detected by the temperature sensor 31*b* and the temperatures detected by the temperature sensors 34 on the heating side or between the temperatures detected by the temperature sensors 34 and the temperature detected by the temperature sensor 31*a* on the cooling side at a target value.

As described above, in both the heat exchanger related to heat medium 15*a* serving as a cooler and the heat exchanger related to heat medium 15*b* serving as a heater, the refrigerant and the heat medium are in counter flow relative to one another. Flowing of the refrigerant and the heat medium in a counter flow relative to one another manner provides good heat exchange efficiency and improves COP.

Further, if a plate-type heat exchanger is used as the heat exchanger related to heat medium 15*a* serving as a cooler, flowing of the evaporation-side refrigerant from below to above in the manner illustrated in the drawing causes the evaporated gaseous refrigerant to move upward due to the buoyant force effect, yielding a reduction in the power of the compressor and appropriate distribution of the refrigerant. If a plate-type heat exchanger is used as the heat exchanger related to heat medium 15*a* serving as a cooler, furthermore, flowing of the heat medium from above to below in the manner illustrated in the drawing causes the chilled heat medium to sink due to the gravitational effect, yielding a reduction in the power of the pump, which is efficient.

Further, if a plate-type heat exchanger is used as the heat exchanger related to heat medium 15*b* serving as a heater, flowing of the condensing-side refrigerant from above to below in the manner illustrated in the drawing causes the condensed liquid refrigerant to move downward due to the gravitational effect, yielding a reduction in the power of the compressor. If a plate-type heat exchanger is used as the heat exchanger related to heat medium 15*b* serving as a heater, furthermore, flowing of the heat medium from below to above in the manner illustrated in the drawing causes the warmed heat medium to float due to the buoyant force effect, yielding a reduction in the power of the pumps, which is efficient.

In the heating main operation mode, since it is not necessary to cause the heat medium to flow to a use side heat exchanger 26 having no heat load (including that in a thermostat-off state), the corresponding one of the heat medium flow control devices 25 closes the passage to prevent the heat medium from flowing to the use side heat exchanger 26. In FIG. 10, the heat medium is caused to flow to the use side heat exchanger 26*a* and the use side heat exchanger 26*b* because heat load is present, whereas the use side heat exchanger 26*c* and the use side heat exchanger 26*d* have no heat load and the respectively associated heat medium flow control device 25*c* and heat medium flow control device 25*d* are fully closed. Once heat load is generated in the use side heat exchanger 26*c* or the use side heat exchanger 26*d*, the heat medium flow control device 25*c* or the heat medium flow control device 25*d* may be opened to allow the heat medium to circulate therein.

[Refrigerant Pipes 4]

As described above, the air-conditioning apparatus 100 according to Embodiment has several operation modes. In these operation modes, a refrigerant flows through the pipes 4 connecting the outdoor unit 1 and the heat medium relay unit 3.

[Pipes 5]

In the several operation modes of the air-conditioning apparatus 100 according to Embodiment, a heat medium such as water or antifreeze flows through the pipes 5 connecting the heat medium relay unit 3 and the indoor units 2.

[Water Temperature Difference Control in Heat Exchanger Related to Heat Medium 15]

Next, water temperature difference control in the heat exchangers related to heat medium 15 in the case of using a non-azeotropic refrigerant mixture will be described in detail.

Figure 6:
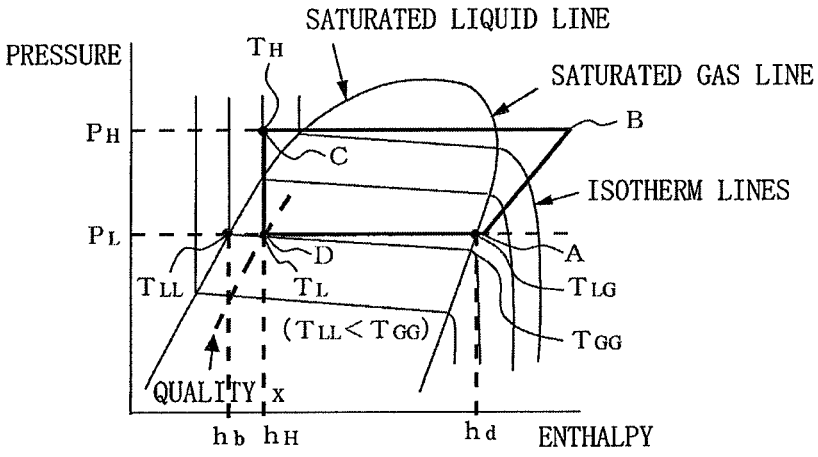
FIG. 6 is a P-h diagram for the case where the non-azeotropic refrigerant according to Embodiment of the present invention is in the state of certain circulation compositions.

In FIG. 6, described previously, the low-temperature and low-pressure gaseous refrigerant (point A) sucked into the compressor 10 is compressed into a high-temperature and high-pressure gaseous refrigerant (point B), and flows into a heat exchanger operating as a condenser (the heat source side heat exchanger 12 or the heat exchanger related to heat medium 15*a* or/and the heat exchanger related to heat medium 15*b*). The high-temperature and high-pressure gaseous refrigerant (point B) flowing into the heat exchanger operating as a condenser is condensed into a high-temperature and high-pressure liquid refrigerant (point C), and flows into the expansion device 16*a* or the expansion device 16*b*. The high-temperature and high-pressure liquid refrigerant (point C) flowing into the expansion device 16*a* or the expansion device 16*b* is expanded into a low-temperature and low-pressure two-phase refrigerant (point D), and flows into a heat exchanger operating as an evaporator (the heat source side heat exchanger 12 or the heat exchanger related to heat medium 15*a* or/and the heat exchanger related to heat medium 15*b*). The low-temperature and low-pressure two-phase refrigerant (point D) flowing into the heat exchanger operating as an evaporator is evaporated into a low-temperature and low-pressure gaseous refrigerant (point A), and is sucked into the compressor 10. For a non-azeotropic refrigerant mixture, there is a temperature difference between the temperature of the saturated gas refrigerant and the temperature of the saturated liquid refrigerant at the same pressure. In a condenser, temperature decreases as quality decreases in the two-phase region (the proportion of the liquid refrigerant increases). In an evaporator, temperature increases as quality increases in the two-phase region (the proportion of the gaseous refrigerant increases).

The operation in this case will be described in detail with reference to FIGS. 11 and 12.

Figure 11:
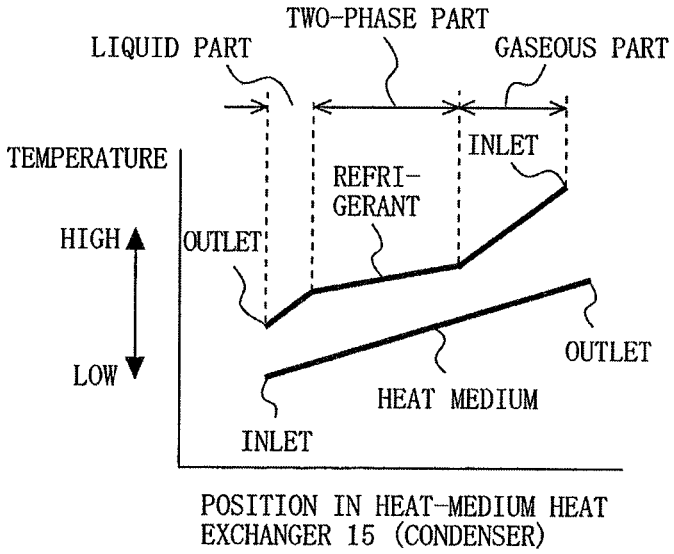
FIG. 11 is an explanatory diagram of operation when a heat exchanger related to heat medium according to Embodiment of the present invention is used as a condenser and when a refrigerant and a heat medium are in counter flow relative to one another.

FIG. 11 is an explanatory diagram of operation when a heat exchanger related to heat medium according to Embodiment of the present invention is used as a condenser and when the refrigerant and the heat medium are in counter flow relative to one another. FIG. 12 is an explanatory diagram of operation when a heat exchanger related to heat medium according to Embodiment of the present invention is used as an evaporator and when the refrigerant and the heat medium are in counter flow relative to one another.

As illustrated in FIG. 11, when the heat exchanger related to heat medium 15 serves as a condenser, the refrigerant flows into the refrigerant flow passage of the heat exchanger related to heat medium 15 as a gaseous refrigerant, and transfers heat to the heat medium on the outlet side of the heat medium passage of the heat exchanger related to heat medium 15 to reduce the temperature, so that the refrigerant is turned into a two-phase refrigerant. In the two-phase refrigerant, the proportion of the liquid refrigerant increases while heat is transferred to the heat medium, and the temperature of the refrigerant decreases in accordance with the temperature difference between the saturated gas refrigerant temperature and the saturated liquid refrigerant temperature. After that, the resulting refrigerant is turned into a liquid refrigerant, and transfers heat to the heat medium on the inlet side of the heat medium passage of the heat exchanger related to heat medium 15, resulting in a further decrease in the temperature of the refrigerant. The refrigerant and the heat medium flow in a counter flow relative to one another manner (in opposite directions), and the temperature of the heat medium increases in the direction from the inlet side to the outlet side.

Next, a description will be given of a case where the heat exchanger related to heat medium 15*a* or/and the heat exchanger related to heat medium 15*b* is used as an evaporator. As illustrated in FIG. 12, when the heat exchanger related to heat medium 15 serves as an evaporator, the refrigerant flows into the refrigerant flow passage of the heat exchanger related to heat medium 15 in a two-phase state, and absorbs heat from the heat medium on the outlet side of the heat medium passage of the heat exchanger related to heat medium 15, resulting in an increase in the proportion of the gaseous refrigerant. This two-phase refrigerant is such that the temperature of the refrigerant increases in accordance with the temperature difference between the temperature of the refrigerant in the two-phase state at the inlet of the evaporator and the temperature of the saturated gas refrigerant. Finally, the two-phase refrigerant absorbs heat from the heat medium on the inlet side of the heat medium passage of the heat exchanger related to heat medium 15, and is turned into a gaseous refrigerant. If the refrigerant and the heat medium flow in a counter flow relative to one another manner (in opposite directions), the temperature of the heat medium decreases in the direction from the inlet side to the outlet side.

Figure 12:
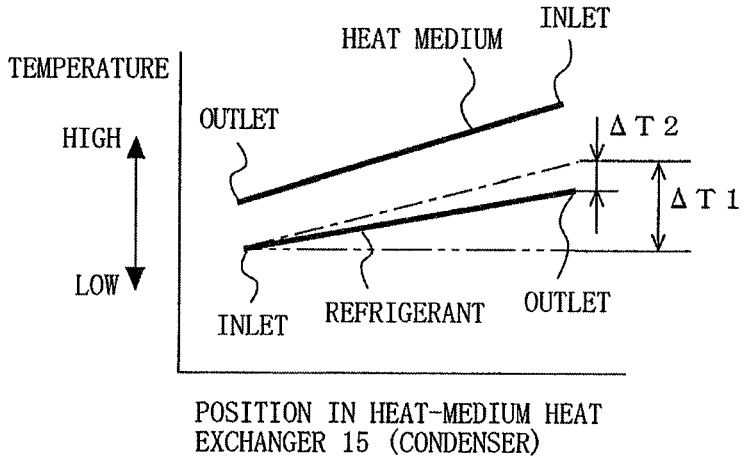
FIG. 12 is an explanatory diagram of operation when a heat exchanger related to heat medium according to Embodiment of the present invention is used as an evaporator and when a refrigerant and a heat medium are in counter flow relative to one another.

At this time, if there is absolutely no pressure loss of the refrigerant in the refrigerant flow passage of the heat exchanger related to heat medium 15, the temperature of the refrigerant increases along a line indicated by a one-dot chain line in FIG. 12, and the temperature of the refrigerant increases by an amount corresponding to the temperature difference between the temperature of the refrigerant in the two-phase state at the inlet of the evaporator and the saturated gas refrigerant temperature at the same pressure. In FIG. 12, the ideal amount of increase in temperature is indicated by $\Delta T1$. Actually, however, because of the presence of a pressure loss in the refrigerant flow passage of the heat exchanger related to heat medium 15, the increase in the temperature of the refrigerant flowing from the inlet to outlet of the heat exchanger related to heat medium 15 is slightly smaller than the increase in temperature indicated by the one-dot chain line in FIG. 12. In FIG. 12, the amount of decrease in the temperature of the refrigerant due to the pressure loss is indicated by $\Delta T2$. If the amount of decrease $\Delta T2$ in temperature due to the pressure loss is sufficiently smaller than the amount of increase in temperature $\Delta T1$ due to the temperature glide of the refrigerant, the temperature difference between the refrigerant and the heat medium can be reduced at individual positions in the heat exchanger related to heat medium 15, compared to the case where a single refrigerant, which undergoes substantially no temperature change in the two-phase state, or a near-azeotropic refrigerant is used, improving heat exchange efficiency.

In FIG. 12, it is assumed that the refrigerant flows out of the heat exchanger related to heat medium 15 in a saturated gas state, that is, the degree of superheating is zero. In addition, the refrigerant temperature in an intermediate portion of the heat exchanger related to heat medium 15 is higher than the refrigerant temperature at the inlet of the heat exchanger related to heat medium 15 regardless of the degree of heating.

Figure 13:
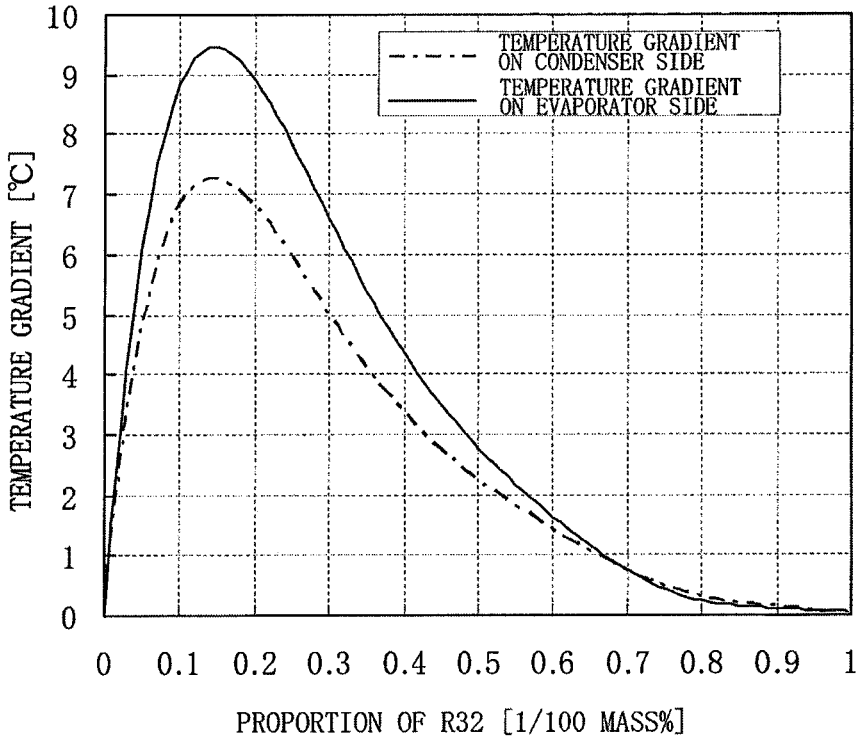
FIG. 13 is a diagram illustrating temperature glides of a non-azeotropic refrigerant mixture in the air-conditioning apparatus according to Embodiment of the present invention.

FIG. 13 is a diagram illustrating temperature glides on the condenser side and the evaporator side when the mixture ratio (mass %) of R32 in a refrigerant mixture of R32 and HFO1234yf varies. The region where the proportion of R32 ranges from 3 mass % to 45 mass % is a region having the largest temperature glide, and the temperature glide on the evaporation side ranges from approximately 3.5 [degrees centigrade] to 9.5 [degrees centigrade]. If the proportion of R32 is in this region, the temperature glide is large. Thus, the temperature glide is still large even if a temperature drop occurs due to a slightly large pressure loss.

As described above, when the heat exchanger related to heat medium 15 serves as an evaporator (cooler), heat exchange efficiency can be improved by controlling the temperature difference of the heat medium flowing through the heat exchanger related to heat medium 15 in accordance with the temperature glide based on the circulation compositions of the refrigerant. In a non-azeotropic refrigerant mixture, however, the circulation compositions of the refrigerant vary depending on the operation state such as an excess amount of refrigerant. Accordingly, the target value in control (first target value) of the temperature difference of the heat medium flowing through the heat exchanger related to heat medium 15 (that is, the temperature difference between the temperature sensor 31 and the temperature sensor 34) is not fixed, where an initial value is stored in advance, but varies in accordance with the time-varying operation state, and may be reset. Specifically, the circulation compositions of the refrigerant may be calculated using the refrigerant circulation composition detection device 50, the operation of which has been described previously, and the target value in control of the temperature difference of the heat medium flowing through the heat exchanger related to heat medium 15 may be set in accordance with the calculated circulation compositions (or the temperature glide of the refrigerant calculated from the circulation compositions).

When the heat exchanger related to heat medium 15 serves as an evaporator, a two-phase refrigerant having a mixture of a liquid refrigerant and a gaseous refrigerant flows into the refrigerant flow passage of the heat exchanger related to heat medium 15, and the temperature of the refrigerant increases in accordance with an increase in gaseous components during the subsequent evaporation process. At this time, a pressure loss occurs in the refrigerant flowing through the refrigerant flow passage of the heat exchanger related to heat medium 15, and a reduction in temperature by the amount corresponding to the pressure loss occurs. In accordance with the factors described above, the temperature difference between the refrigerant on the outlet side of the heat exchanger related to heat medium 15 and the refrigerant on the inlet side of the inlet-side heat exchanger related to heat medium 15 is determined. The temperature difference between the refrigerant on the outlet side of the heat exchanger related to heat medium 15 and the refrigerant on the inlet side of the heat exchanger related to heat medium 15 is assumed to be, for example, 5 degrees centigrade. If the pressure loss in the refrigerant is excessively high, the performance of the heat exchanger related to heat medium 15 deteriorates. Thus, the heat exchanger related to heat medium 15 according to Embodiment is configured such that the reduction in temperature due to the pressure loss is appropriately 1 to 2 degrees centigrade. Further, the temperature of the heat medium flowing through the heat exchanger related to heat medium 15 is higher than that of the refrigerant, and the temperature difference (average temperature difference) between the heat medium and the refrigerant is approximately 3 to 7 degrees centigrade. In consideration of the foregoing, the target value in control of the difference between the inlet and outlet temperatures of the heat medium flowing through the heat exchanger related to heat medium 15 is set to a value substantially equal to the temperature difference between the inlet and outlet temperatures of the refrigerant in the heat exchanger related to heat medium 15, providing good heat exchange efficiency. If the difference between the inlet and outlet temperatures of the refrigerant in the heat exchanger related to heat medium 15 is 5 degrees centigrade, the target value in control of the difference between the inlet and outlet temperatures of the heat medium flowing through the heat exchanger related to heat medium 15 may be set to 3 to 7 degrees centigrade.

A pressure loss in the refrigerant is predictable to some extent based on the operation state. Thus, when the heat exchanger related to heat medium 15 serves as an evaporator, if, for example, the calculated temperature glide of the refrigerant is 5 degrees centigrade, settings may be made such that the target value in control of the heat medium is set to a value in the range from 5 degrees centigrade, which is substantially the same as the calculated temperature glide of the refrigerant, to a slightly larger value, or 7 degrees centigrade, for a significantly small pressure loss in the refrigerant in the heat exchanger related to heat medium 15, and the target value in control is set to 4 degrees centigrade, 3 degrees centigrade, or the like, which is smaller than the calculated temperature glide of the refrigerant for a large pressure loss to some extent. Further, if, for example, the calculated temperature glide of the refrigerant is, for example, 7 degrees centigrade, settings may be made such that the target value in control of the heat medium is set to a value in the range from 7 degrees centigrade to 9 degrees centigrade for a significantly small pressure loss, and the target value in control is set to 6 degrees centigrade or 5 degrees centigrade for a large pressure loss to some extent. This control is automatically performed by the controller 60*b* on the basis of the circulation compositions calculated by the controller 60*a*.

Further, when the heat exchanger related to heat medium 15 is used as a condenser, the regions of the heated gaseous refrigerant and the subcooled-liquid refrigerant in the heat exchanger related to heat medium 15 are large to some extent. Thus, the target value in control of the temperature difference of the heat medium may be set to a value larger than the calculated temperature glide of the refrigerant. For example, if the calculated temperature glide of the refrigerant is 5 degrees centigrade, the target value in control of the temperature difference of the heat medium may be set to a value larger than 5 degrees centigrade, such as 7 degrees centigrade.

When a non-azeotropic refrigerant mixture is used as a refrigerant and the heat exchanger related to heat medium 15 is used as an evaporator, an excessive reduction in the temperature of the refrigerant reduces the temperature of a heat medium such as water to the freezing temperature or less, causing the heat medium to be frozen. Freezing of the heat medium in the heat exchanger related to heat medium 15 may lead to a collapse or the like of the heat exchanger related to heat medium 15, which is dangerous. Thus, there is a need for prevention of freezing. In Embodiment, therefore, it is determined whether or not there is a possibility of freezing of the heat medium flowing through the heat medium flow passage of the heat exchanger related to heat medium 15, based on the temperature of the refrigerant flowing through the refrigerant flow passage of the heat exchanger related to heat medium 15. If the temperature of the refrigerant flowing through the refrigerant flow passage of the heat exchanger related to heat medium 15 is higher than a certain value, the control described above is performed. If the temperature of the refrigerant flowing through the refrigerant flow passage of the heat exchanger related to heat medium 15 is less than or equal to the certain value, the target value in control of the temperature difference of the heat medium flowing through the heat exchanger related to heat medium 15 (that is, the temperature difference between the temperature sensor 31 and the temperature sensor 34) is set to a target value in control (second target value) lower than the lower limit of the range within which the first target value can be changed. This can increase the flow rate of the heat medium flowing through the heat medium flow passage of the heat exchanger related to heat medium 15, and can prevent the outlet temperature of the heat medium from decreasing, thereby more reliably preventing freezing of the heat medium.

In Embodiment, the description has been made taking an example where when a non-azeotropic refrigerant mixture is used as a refrigerant, the temperature difference of the heat medium flowing through the heat exchanger related to heat medium 15 is changed in accordance with the operation state of the refrigerant circuit A. Embodiment is not limited to this example. The air-conditioning apparatus 100 according to Embodiment can use various refrigerants. For example, if a refrigerant with transition to the supercritical state, such as carbon dioxide, is used as a refrigerant, a gas cooler serving as a heater experiences a large change in the temperature difference between the refrigerant temperature on the inlet side of the gas cooler and the refrigerant temperature on the outlet side of the gas cooler in accordance with the operation state of the refrigerant circuit A. Therefore, the efficiency of the heat exchanger related to heat medium 15 can be improved by changing the corresponding temperature difference of the heat medium in accordance with the operation state of the refrigerant circuit A.

In Embodiment, furthermore, a temperature glide is calculated based on the circulation compositions of the refrigerant, and the temperature difference of the heat medium flowing through the heat exchanger related to heat medium 15 is controlled in accordance with the temperature glide. Embodiment is not limited to this form. The temperature of the refrigerant flowing into the refrigerant flow passage of the heat exchanger related to heat medium 15 and the temperature of the refrigerant flowing out of the refrigerant passage may be detected by the temperature sensor 35, and the temperature difference of the heat medium flowing through the heat exchanger related to heat medium 15 may be controlled based on the temperature of the refrigerant flowing into the refrigerant flow passage of the heat exchanger related to heat medium 15 and the refrigerant flowing out of the refrigerant passage. In addition, a detection value of the temperature sensor 35 among the temperature sensors 35*a* to 35*d* (refrigerant temperature detection device) which is on the outlet side of the refrigerant flow passage of the heat exchanger related to heat medium 15 may be used as the temperature of the refrigerant flowing through the refrigerant flow passage of the heat exchanger related to heat medium 15.

The temperature difference between the temperature sensor 31 and the temperature sensor 34 is referred to here as a temperature difference of the heat medium flowing through the heat exchanger related to heat medium 15, or may be referred to as an inlet/outlet temperature difference of the use side heat exchanger 26, where both temperature differences are the same unless heat penetration into the pipe 5, or the like occurs. Alternatively, another temperature sensor may be installed on the inlet side of the use side heat exchanger 26 to control the temperature difference between the temperature detected thereby and that of the temperature sensor 34.

Note that a method for reducing the flow rate of the flow having passed through the pump 21 is to reduce the frequency to reduce the flow rate when the pump 21 is driven by a brushless DC inverter, an AC inverter, or the like. When the pump 21 is not of an inverter type, the voltage to be applied to the pump 21 may be reduced by switching a resistor or any other method. Alternatively, a valve whose opening area for a passage can be varied may be provided on the suction side or discharge side of the pump 21, and the passage area may be reduced to reduce the flow rate of the flow to the pump 21.

The air-conditioning apparatus 100 according to Embodiment is designed such that if only heating load or cooling load is generated in the use side heat exchangers 26, the opening degrees of the associated second heat medium passage switching devices 22 and the associated first heat medium passage switching devices 23 are set to an intermediate value to allow the heat medium to flow through both the heat exchanger related to heat medium 15*a* and the heat exchanger related to heat medium 15*b*. Thus, both the heat exchanger related to heat medium 15*a* and the heat exchanger related to heat medium 15*b* can be used for the heating operation or the cooling operation. This can increase the heat transfer area, providing an efficient heating operation or cooling operation.

Further, if both heating load and cooling load are generated in the use side heat exchangers 26, the second heat medium passage switching device 22 and the first heat medium passage switching device 23, which are associated with the use side heat exchanger 26 being in the heating operation, are switched to the passage connected to the heat exchanger related to heat medium 15*b* for use in heating, and the second heat medium passage switching device 22 and the first heat medium passage switching device 23, which are associated with the use side heat exchanger 26 being in the cooling operation, are switched to the passage connected to the heat exchanger related to heat medium 15*a* for use in cooling. This enables the individual indoor units 2 to freely perform the heating operation and the cooling operation.

In Embodiment, both the second heat medium passage switching devices 22 and the first heat medium passage switching devices 23 are provided. Alternatively, only the first heat medium passage switching devices 23 may allow the individual indoor units 2 to freely perform the heating operation and the cooling operation (to perform a simultaneous cooling and heating operation). At this time, the flows of the heat medium out of the individual indoor units 2 merge on the way (if the second heat medium passage switching devices 22 are provided, at the positions where the second heat medium passage switching devices 22 are located). That is, the flow of a cold heat medium (for example, 10 degrees centigrade) out of the use side heat exchanger 26 on the cooling side and the flow of a hot heat medium (for example, 40 degrees centigrade) out of the use side heat exchanger 26 on the heating side are caused to merge into an intermediate-temperature heat medium (for example, 25 degrees centigrade), and the intermediate-temperature heat medium flows into the heat exchangers related to heat medium 15*a* and 15*b*. Then, the heat exchanger related to heat medium 15*a* chills the intermediate-temperature heat medium to generate a cold heat medium (for example, 5 degrees centigrade), and the heat exchanger related to heat medium 15*b* chills the intermediate-temperature heat medium to generate a hot heat medium (for example, 45 degrees centigrade). Thereafter, the effect of the first heat medium passage switching devices 23 causes the cold heat medium to flow into the use side heat exchanger 26 on the cooling side and the hot heat medium to flow into the use side heat exchanger 26 on the heating side, which are used for the cooling operation and the heating operation, respectively. In this case, since the cold heat medium and the hot heat medium merge into an intermediate-temperature heat medium on the outlet side of the use side heat exchangers 26, waste occurs in terms of the amount of heat. Therefore, both the second heat medium passage switching devices 22 and the first heat medium passage switching devices 23 allow a more efficient operation, whereas only the first heat medium passage switching devices 23 allow a cooling and heating mixed operation at low cost. Note that a structure in which only the second heat medium passage switching devices 22 are provided does not allow a cooling and heating mixed operation.

Figure 14:
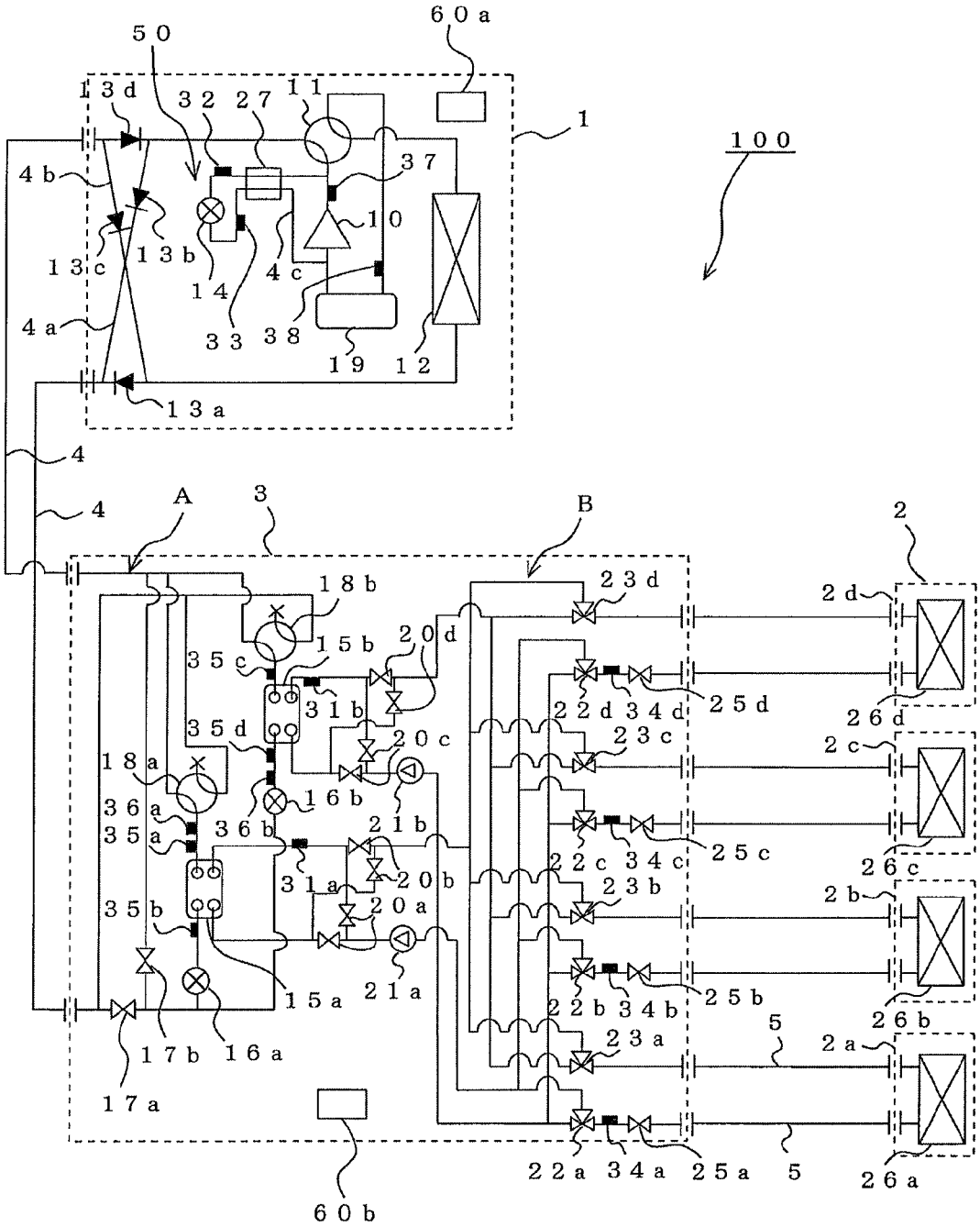
FIG. 14 is a schematic circuit configuration diagram illustrating another example circuit configuration of the air-conditioning apparatus according to Embodiment of the present invention.

Furthermore, each of the heat medium passage reversing devices 20 described in Embodiment may not only be a device capable of switching between three-way passages, such as a three-way valve, but also be implemented by combining two devices each configured to open and close two-way passages, such as opening and closing valves as illustrated in FIG. 14. Any device capable of switching between passages may be used. A device capable of changing the flow rates for three-way passages, such as a stepping-motor-driven mixing valve, may be used, or two devices each capable of changing the flow rates for two-way passages, such as an electronic expansion valves, may be used in combination. Similarly, each of the second heat medium passage switching devices 22 and the first heat medium passage switching devices 23 may also be designed to switch between passages, such as a device capable of switching between three-way passages, such as a three-way valve, or a device formed by combining two devices, each configured to open and close two-way passages, such as opening and closing valves. Further, each of the second heat medium passage switching devices 22 and the first heat medium passage switching devices 23 may be a device capable of changing the flow rates of three-way passages, such as a stepping-motor-driven mixing valve, or may be implemented by, for example, combining two devices each capable of changing the flow rates of two-way passages, such as electronic expansion valves. In this case, water hammer caused by a sudden opening and closing of a passage can also be prevented. In Embodiment, furthermore, the description has been made taking an example where each of the heat medium flow control devices 25 is a two-way valve. Alternatively, each of the heat medium flow control devices 25 may be a control valve having three-way passages, and may be disposed together with bypass pipes that bypass the use side heat exchangers 26.

In addition, each of the heat medium flow control devices 25 may be implemented as an stepping-motor-driven device capable of controlling the flow rate of the flow through a passage, or may be a two-way valve or a three-way valve whose one end is closed. Alternatively, each of the heat medium flow control devices 25 may be implemented as a device that opens and closes two-way passages, such as an opening and closing valve, which is repeatedly turned on and off to control an average flow rate.

Further, each of the second refrigerant passage switching devices 18 is illustrated as a four-way valve, but is not limited thereto. Each of the second refrigerant passage switching device 18 may be configured by using a plurality of two-way passage switching valves or three-way passage switching valves so that refrigerants flow in the same manner.

The air-conditioning apparatus 100 according to Embodiment has been described as being capable of performing a cooling and heating mixed operation, but is not limited thereto. The air-conditioning apparatus 100, which is configured to include a single heat exchanger related to heat medium 15 and a single expansion device 16, to which a plurality of use side heat exchangers 26 and a plurality of heat medium flow control devices 25 are connected in parallel, and configured to perform only either the cooling operation or the heating operation, would achieve similar advantages.

Further, while in the description of the operation of the refrigerant and heat medium flowing through the heat exchanger related to heat medium 15, the description has been given of the case where the refrigerant and the heat medium are in counter flow relative to one another in both cases of cooling the heat medium and heating the heat medium, but, of course, Embodiment is not limited thereto. The flows may be in counter flow relative to one another only in the case of cooling the heat medium, and in parallel flow in the case of heating the heat medium, or may be in counter flow relative to one another only in the case of heating the heat medium and in parallel flow in the case of cooling the heat medium. The heat exchanger related to heat medium 15 in which the flows are in counter flow relative to one another may be configured such that the target value in control of the temperature difference of the heat medium is automatically changed in accordance with the temperature glide of the refrigerant, and similar advantages are achieved.

It goes without saying that the same applies when a single use side heat exchanger 26 and a single heat medium flow control device 25 are connected. Additionally, there is of course no problem if a plurality of devices designed to operate in the same manner are disposed as the heat exchangers related to heat medium 15 and the expansion devices 16. Furthermore, the description has been made taking an example where the heat medium flow control devices 25 are incorporated in the heat medium relay unit 3, but Embodiment is not limited thereto. The heat medium flow control devices 25 may be incorporated in the indoor units 2, or may be configured separately from the heat medium relay unit 3 and the indoor units 2.

Further, the heat medium is not limited to water, and may be implemented using, for example, brine (antifreeze), a liquid mixture of brine and water, a liquid mixture of water and anti-corrosive additive, or the like. Therefore, because of the use of a heat medium which provides a high level of safety, the air-conditioning apparatus 100 may contribute to improved safety even if the heat medium leaks into the indoor space 7 through the indoor units 2.

Further, each of the heat source side heat exchanger 12 and the use side heat exchangers 26*a* to 26*d* is generally equipped with an air-sending device, and the blowing of air often facilitates condensation or evaporation, but is not limited thereto. For example, each of the use side heat exchangers 26*a* to 26*d* may be implemented using a device that utilizes radiation, like a panel heater, and the heat source side heat exchanger 12 may be of a water-cooled type that causes heat to move by water or antifreeze. Any structure capable of transferring heat or removing heat may be used.

Further, while the description has been made with reference to FIG. 2, taking an example of the four use side heat exchangers 26*a* to 26*d*, any number of use side heat exchangers may be connected.

Further, the description has been made with reference to FIG. 2, taking an example of the two heat exchangers related to heat medium 15*a* and 15*b*, but, of course, Embodiment is not limited thereto. Any number of heat exchangers related to heat medium which are configured to be capable of cooling or/and heating a heat medium may be installed.

Further, the pumps 21*a* and 21*b* are not necessarily single ones, and each of them may be implemented by arranging a plurality of small-capacity pumps in parallel.

Reference Signs List

1 outdoor unit (heat source unit), 2 (2*a*, 2*b*, 2*c*, 2*d*) indoor unit, 3 heat medium relay unit, 4 refrigerant pipe, 4*a* first connecting pipe, 4*b* second connecting pipe, 4*c* high-low pressure bypass pipe, 5 pipe, 6 outdoor space, 7 indoor space, 8 space, 9 structure, 10 compressor, 11 first refrigerant passage switching device (four-way valve), 12 heat source side heat exchanger, 13*a*, 13*b*, 13*c*, 13*d* check valve, 14 expansion device, 15 (15*a*, 15*b*) heat exchanger related to heat medium, 16 (16*a*, 16*b*) expansion device, 17 (17*a*, 17*b*) opening and closing device, 18 (18*a*, 18*b*) second refrigerant passage switching device, 19 accumulator, 20 (20*a*, 20*b*, 20*c*, 20*d*) heat medium passage reversing device, 21 (21*a*, 21*b*) pump (heat medium sending device), 22 (22*a*, 22*b*, 22*c*, 22*d*) second heat medium passage switching device, 23 (23*a*, 23*b*, 23*c*, 23*d*) first heat medium passage switching device, 25 (25*a*, 25*b*, 25*c*, 25*d*) heat medium flow control device, 26 (26*a*, 26*b*, 26*c*, 26*d*) use side heat exchanger, 27 refrigerant-refrigerant heat exchanger, 31 (31*a*, 31*b*) temperature sensor, 32 high-pressure side refrigerant temperature detection device, 33 low-pressure side refrigerant temperature detection device, 34 (34*a*, 34*b*, 34*c*, 34*d*) temperature sensor, 35 (35*a*, 35*b*, 35*c*, 35*d*) temperature sensor, 36 (36*a*, 36*b*) pressure sensor, 37 high-pressure side pressure detection device, 38 low-pressure side pressure detection device, 50 refrigerant circulation composition detection device, 60 (60*a*, 60*b*) controller, 100 air-conditioning apparatus, A refrigerant circuit, B heat medium circuit.

The invention claimed is:

1. An air-conditioning apparatus comprising:

a refrigerant circuit in which a compressor, a refrigerant passage switching device that switches a passage of a refrigerant discharged from the compressor, a heat source side heat exchanger, a first expansion device, and a refrigerant flow passage of a heat exchanger related to heat medium are connected via a refrigerant pipe through which the refrigerant is distributed;

a heat medium circuit in which a heat medium flow passage of the heat exchanger related to heat medium, a heat medium sending device, a use side heat exchanger, and a heat medium flow control device, the heat medium flow control device being disposed in an inlet-side passage or outlet-side passage of the use side heat exchanger and controlling a flow rate of the heat medium circulating in the use side heat exchanger, are connected via a heat medium pipe through which a heat medium is distributed; and a controller that controls the heat medium flow control device wherein the refrigerant flowing through the refrigerant circuit is a non-azeotropic refrigerant mixture including two or more components and having a temperature glide between a saturated gas temperature and a saturated liquid temperature at the same pressure, wherein the refrigerant flowing through the refrigerant flow passage of the heat exchanger related to heat medium and the heat medium flowing through the heat medium flow passage of the heat exchanger related to heat medium are in counter flow relative to one another, and wherein the controller controls the heat medium flow adjustment device on the basis of the composition of the refrigerant or a temperature glide of the refrigerant between a saturated gas temperature and a saturated liquid temperature at the same pressure, the temperature glide being calculated based on the composition.

2. The air-conditioning apparatus of claim 1, further comprising a heat medium passage reversing device that is disposed in the heat medium circuit and that is capable of switching a direction of the heat medium flowing through the heat medium flow passage of the heat exchanger related to heat medium between a normal direction and a reverse direction.

3. The air-conditioning apparatus of claim 2, wherein the heat medium passage reversing device is a three-way valve or a plurality of two-way valves disposed at each of one end and the other end of the heat medium passage of the heat exchanger related to heat medium.

4. The air-conditioning apparatus of claim 3, wherein the heat medium passage reversing devices include a first heat medium passage reversing device disposed at the one end of the heat medium passage of the heat exchanger related to heat medium and connected to the other end of the heat medium passage of the heat exchanger related to heat medium by pipe at a first connection port, and a second heat medium passage reversing device disposed at the other end of the heat medium passage of the heat exchanger related to heat medium and connected to the one end of the heat medium passage of the heat exchanger related to heat medium by pipe at a second connection port, wherein the first connection port is disposed in a passage between the other end of the heat medium passage of the heat exchanger related to heat medium and the second heat medium passage reversing device, and wherein the second connection port is disposed in a passage between the one end of the heat medium passage of the heat exchanger related to heat medium and the first heat medium passage reversing device.

5. The air-conditioning apparatus of claim 1, wherein the refrigerant is a refrigerant mixture containing at least tetrafluoropropene and R32.

6. The air-conditioning apparatus of claim 5, wherein the refrigerant is a refrigerant mixture containing at least HFO1234yf and R32, and R32 is mixed at a proportion ranging from 3 mass % to 45 mass %.

7. The air-conditioning apparatus of claim 1, wherein the air-conditioning apparatus comprises a plurality of the heat exchangers related to heat medium, and a plurality of the heat medium sending devices, wherein the air-conditioning apparatus further comprises at least first heat medium passage switching devices each connected to a passage on an outlet side of one of the plurality of heat exchangers related to heat medium, each of the first heat medium passage switching devices selecting one of the heat exchangers related to heat medium which communicates with a passage on an inlet side of the use side heat exchanger.

8. The air-conditioning apparatus of claim 7, further comprising second heat medium passage switching devices each connected to a passage on an inlet side of one of the plurality of heat exchangers related to heat medium, each of the second heat medium passage switching devices selecting one of the heat exchangers related to heat medium which communicates with a passage on an outlet side of the use side heat exchanger.

9. The air-conditioning apparatus of claim 8, wherein each of the second heat medium passage switching devices is a three-way valve or a plurality of two-way valves disposed on an outlet side of a heat medium flow passage of the use side heat exchanger.

10. The air-conditioning apparatus of claim 7, further comprising a cooling and heating mixed function for cooling the heat medium using at least one of the heat exchangers related to heat medium and for heating the heat medium using at least one of the heat exchangers related to heat medium, wherein passages are formed so that the refrigerant and the heat medium flow in opposite directions in both one of the heat exchangers related to heat medium which serves as a cooler that cools the heat medium and one of the heat exchangers related to heat medium which serves as a heater that heats the heat medium, and wherein the first target value for the heat exchanger related to heat medium which serves as a heater that heats the heat medium is larger than the first target value for the heat exchanger which serves as a cooler that cools the heat medium.

11. The air-conditioning apparatus of claim 7, wherein each of the first heat medium passage switching devices is a three-way valve or a plurality of two-way valves disposed on an inlet side of a heat medium flow passage of the use side heat exchanger.

12. The air-conditioning apparatus of claim 1, further comprising:

a first heat medium temperature detection device that is disposed in the inlet-side passage of the use side heat exchanger and that detects a temperature of the heat medium; and a second heat medium temperature detection device that is disposed in the outlet-side passage of the use side heat exchanger and that detects a temperature of the heat medium, wherein the controller controls the heat medium flow control device so that a temperature difference between a detection value of the first heat medium temperature detection device and a detection value of the second heat medium temperature detection device is equal to a first target value, and changes the first target value, which is a target value in control of the temperature difference between the detection value of the first heat medium temperature detection device and the detection value of the second heat medium temperature detection device, on the basis of the composition of the refrigerant or the temperature glide of the refrigerant between a saturated gas temperature and a saturated liquid temperature at the same pressure, the temperature glide being calculated based on the composition.

13. The air-conditioning apparatus of claim 12, comprising a refrigerant circulation composition detection device used to detect a composition of the refrigerant circulating in the refrigerant circuit, wherein the controller determines the composition of the refrigerant using the refrigerant circulation composition detection device.

14. The air-conditioning apparatus of claim 13, wherein the refrigerant circulation composition detection device at least includes:

a low-pressure side pressure detection device that detects a low-pressure side pressure of the compressor;

a high-low pressure bypass pipe that connects a passage between a discharge side of the compressor and the refrigerant passage switching device to a passage between a suction side of the compressor and the refrigerant passage switching device;

a second expansion device disposed in the high-low pressure bypass pipe;

a high-pressure side temperature detection device disposed in an inlet side of the second expansion device, of the high-low pressure bypass pipe;

a low-pressure side temperature detection device disposed in an outlet side of the second expansion device, of the high-low pressure bypass pipe, and a refrigerant-refrigerant heat exchanger that exchanges heat between refrigerants flowing through pipes located before and after the second expansion device;

wherein the controller calculates a composition of the refrigerant or the temperature glide between the saturated gas temperature and the saturated liquid temperature at the same pressure of the refrigerant, the temperature glide being calculated based on the composition, using at least the pressure detected by the low-pressure side pressure detection device, a temperature detected by the high-pressure side temperature detection device, and a temperature detected by the low-pressure side temperature detection device.

15. The air-conditioning apparatus of claim 12, wherein in a condition where the heat exchanger related to heat medium serves as a cooler that cools the heat medium, the controller changes the first target value to a value that is substantially equal to a temperature difference between the refrigerant flowing into the refrigerant flow passage of the heat exchanger related to heat medium and the refrigerant flowing out of the refrigerant flow passage of the heat exchanger related to heat medium.

16. The air-conditioning apparatus of claim 15, wherein a temperature difference between the "temperature difference between the refrigerant flowing into the refrigerant flow passage of the heat exchanger related to heat medium and the refrigerant flowing out of the refrigerant flow passage of the heat exchanger related to heat medium" and "the first target value" is equal to or within 2 degrees centigrade.

17. The air-conditioning apparatus of claim 12, wherein in a condition where the heat exchanger related to heat medium serves as a heater that heats the heat medium, the controller changes the first target value to a value larger than a temperature difference between the saturated gas temperature and the saturated liquid temperature at the same pressure of the refrigerant, the temperature difference being calculated based on the composition of the refrigerant.

18. The air-conditioning apparatus of claim 12, wherein in a condition where the heat exchanger related to heat medium serves as a cooler that cools the heat medium, when the temperature of the refrigerant flowing through the refrigerant flow passage of the heat exchanger related to heat medium is less than or equal to a certain value, the controller controls the heat medium flow control device so that the temperature difference between the detection value of the first heat medium temperature detection device and the detection value of the second heat medium temperature detection device is equal to a second target value lower than a lower limit of a range within which the first target value can be changed.

19. The air-conditioning apparatus of claim 18, further comprising a refrigerant temperature detection device that detects a temperature of the refrigerant, the refrigerant temperature detection device being provided on an outlet side of the refrigerant flow passage when the heat exchanger related to heat medium serves as a cooler that cools the heat medium, wherein a detection value of the refrigerant temperature detection device is used as the temperature of the refrigerant flowing through the refrigerant flow passage of the heat exchanger related to heat medium.

20. The air-conditioning apparatus of claim 18, wherein the temperature of the refrigerant flowing through the refrigerant flow passage of the heat exchanger related to heat medium is calculated based on "a temperature difference between a saturated gas temperature and a saturated liquid temperature at the same pressure of the refrigerant, the temperature difference being calculated based on a composition of the refrigerant".

21. The air-conditioning apparatus of claim 12, wherein the compressor, the refrigerant passage switching device and the heat source side heat exchanger are accommodated in an outdoor unit, wherein the heat exchanger related to heat medium is accommodated in a heat medium relay unit, wherein the heat medium sending device is accommodated in the heat medium relay unit or is disposed near the heat medium relay unit, wherein the first heat medium temperature detection device, the second heat medium temperature detection device, and the heat medium flow control device are accommodated in the heat medium relay unit or an indoor unit or is disposed near the heat medium relay unit or near the indoor unit, wherein the use side heat exchanger is accommodated in the indoor unit, wherein the controller includes a first controller accommodated in the outdoor unit, and a second controller disposed in at least one of the heat medium relay unit and the indoor unit, wherein the first controller and the second controller are connected via wire or wirelessly so as to be capable of communicating with each other, wherein the first controller transmits the composition of the refrigerant or the temperature glide between the saturated gas temperature and the saturated liquid temperature at the same pressure of the refrigerant, the temperature glide being calculated based on the composition, to the second controller, and wherein the second controller changes the first target value on the basis of the composition of the refrigerant or the temperature glide, which has been transmitted.

22. The air-conditioning apparatus of claim 21, wherein the outdoor unit and the heat medium relay unit are connected by two pipes, and the heat medium relay unit and each indoor unit are connected by two pipes.

* * * * *